US011904990B2

(12) United States Patent
Johanneck

(10) Patent No.: US 11,904,990 B2
(45) Date of Patent: Feb. 20, 2024

(54) FLOATING DRIVE-ON PONTOON PORT

(71) Applicant: Innovative Outdoor Solutions, Inc., Maple Lake, MN (US)

(72) Inventor: Richard G. Johanneck, Maple Lake, MN (US)

(73) Assignee: Innovative Outdoor Solutions, Inc., Maple Lake, MN (US)

( * ) Notice: Subject to any disclaimer, the term of this patent is extended or adjusted under 35 U.S.C. 154(b) by 342 days.

(21) Appl. No.: 17/465,589

(22) Filed: Sep. 2, 2021

(65) Prior Publication Data

US 2022/0063778 A1 Mar. 3, 2022

Related U.S. Application Data

(60) Provisional application No. 63/073,724, filed on Sep. 2, 2020.

(51) Int. Cl.

| | |
|---|---|
| ***B63C 1/02*** | (2006.01) |
| ***B63C 3/08*** | (2006.01) |
| ***B63C 3/02*** | (2006.01) |

(52) U.S. Cl.

CPC ..... *B63C 1/02* (2013.01); *B63C 3/02* (2013.01); *B63C 3/08* (2013.01)

(58) Field of Classification Search

CPC .... B63C 1/02; B63C 1/04; B63C 1/10; B63C 1/06; B63C 1/08; B63C 1/12; B63C 15/00

See application file for complete search history.

(56) References Cited

U.S. PATENT DOCUMENTS 5,281,055 A 1/1994 Neitzke et al.
6,006,687 A 12/1999 Hillman et al.
(Continued)

FOREIGN PATENT DOCUMENTS

CA 2770645 A1 * 8/2013 ..... B63C 1/02

OTHER PUBLICATIONS

EZ Dock Floating Dock Systems, "EZ Pontoon Life, 2,000 lbs. capacity", EZ Dock, https://www.ezdockinnovations.com/product-details.cfm?item=ez-pontoon-lift-2000-pounds.

*Primary Examiner* — Andrew Polay
(74) *Attorney, Agent, or Firm* — Dicke, Billig & Czaja, PLLC

(57) ABSTRACT

One example provides a floating drive-on pontoon port including a plurality of floating sections pivotally coupled together in series with one another to form an articulating port track base and an articulating starboard track base extending longitudinally in parallel with one another, the port and starboard track bases each having a lower surface to be disposed in water and an opposing upper surface to face away from the water. A port transport track extends longitudinally across the upper surface of the port track base, and a starboard transport track extends longitudinally across the upper surface of the starboard track base and in parallel with the port transport track, the port and starboard transport tracks each comprising a series of spaced apart rollers configured to respectively receive, transport, and support a port pontoon and a starboard pontoon of a pontoon during loading, unloading, and storage of the pontoon boat on the pontoon port. A lateral position of the port and starboard transport tracks relative to one another is adjustable to adjust a lateral distance between the port and starboard transport tracks to accommodate pontoon boats of different widths.

32 Claims, 18 Drawing Sheets

(56) References Cited

U.S. PATENT DOCUMENTS

| | | | | |
|---|---|---|---|---|
| 6,431,106 | B1 | 8/2002 | Eva, III | |
| 6,526,902 | B1 * | 3/2003 | Faber | B63C 1/02 114/263 |
| 7,069,872 | B2 | 7/2006 | Ostreng | |
| 7,293,522 | B1 | 11/2007 | Elson | |
| 9,180,944 | B2 | 11/2015 | Imel et al. | |
| D764,377 | S * | 8/2016 | Ross | D12/317 |
| 2005/0035259 | A1 * | 2/2005 | Maffett | B63C 15/00 248/346.06 |
| 2009/0044739 | A1 | 2/2009 | Imel et al. | |
| 2009/0044740 | A1 | 2/2009 | Imel et al. | |
| 2009/0120344 | A1 | 5/2009 | Dickman | |
| 2009/0297310 | A1 * | 12/2009 | Heck | B60P 3/1033 414/803 |
| 2014/0248083 | A1 | 9/2014 | Imel et al. | |
| 2022/0119077 | A1 * | 4/2022 | Nelson | B63B 7/04 |

* cited by examiner

FLOATING DRIVE-ON PONTOON PORT

CROSS-REFERENCE TO RELATED APPLICATION

This application is a non-provisional of U.S. Patent Application Ser. No. 63/073,724, filed Sep. 2, 2020, which is incorporated herein by reference.

BACKGROUND

Floating watercraft ports provide easy drive-on docking and out-of-water storage of watercraft having various hull types, including pontoon boats. Pontoon boats are manufactured in a number of lengths and widths, and employ pontoons of various shapes and hull configurations (e.g., two- and three-pontoon configurations (commonly referred to as tri-toons)). Accordingly, it is advantageous for a floating drive-on pontoon port to be adjustable to accommodate and simplify the loading and unloading (to/from the port) of pontoon boats of various sizes and configurations.

SUMMARY

One example provides a floating drive-on pontoon port including a plurality of floating sections pivotally coupled together in series with one another to form an articulating port track base and an articulating starboard track base extending longitudinally in parallel with one another, the port and starboard track bases each having a lower surface to be disposed in water and an opposing upper surface to face away from the water. A port transport track extends longitudinally across the upper surface of the port track base, and a starboard transport track extends longitudinally across the upper surface of the starboard track base and in parallel with the port transport track, the port and starboard transport tracks each comprising a series of spaced apart rollers configured to respectively receive, transport, and support a port pontoon and a starboard pontoon of a pontoon during loading, unloading, and storage of the pontoon boat on the pontoon port. A lateral position of the port and starboard transport tracks relative to one another is adjustable to adjust a lateral distance between the port and starboard transport tracks to accommodate pontoon boats of different widths.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

Figure 1:
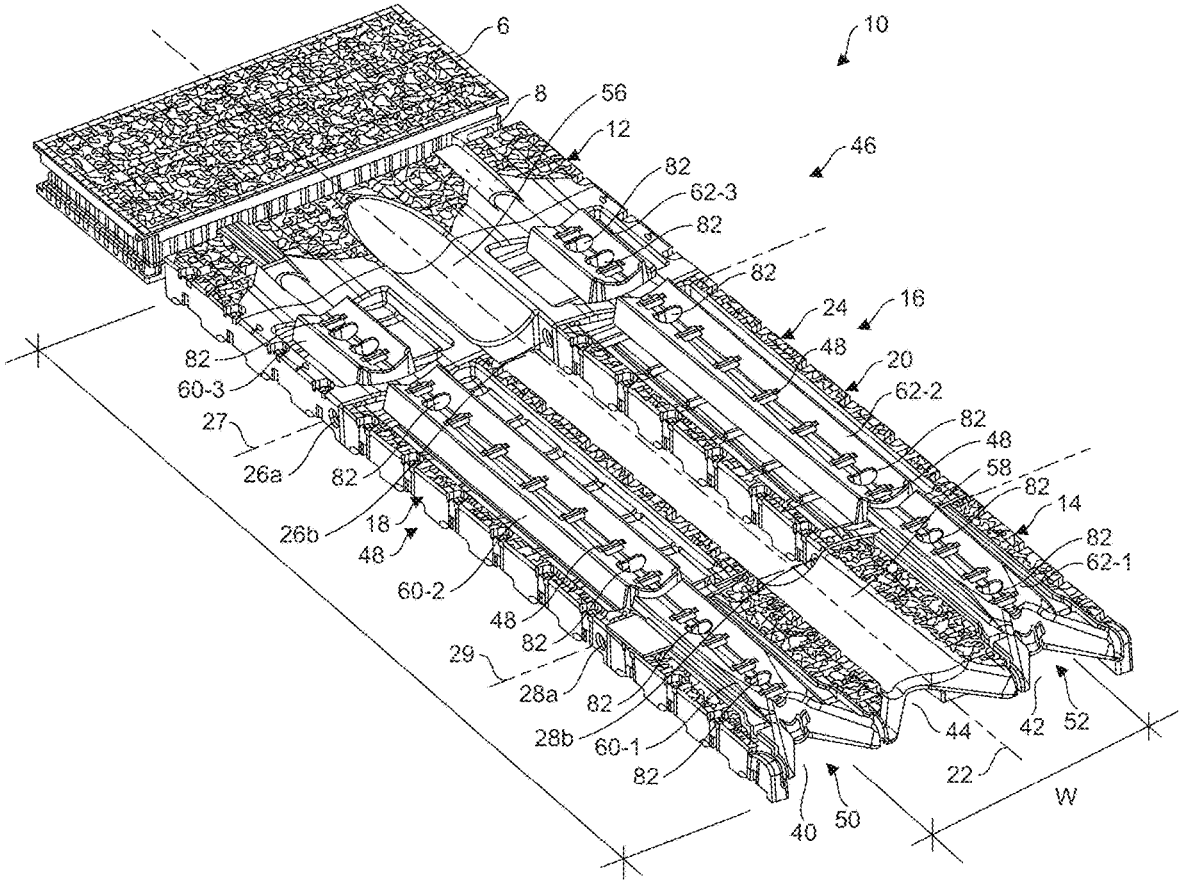
FIG. 1 is a perspective view of a floating drive-on pontoon port, according to one example of the present disclosure.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims. It is to be understood that the features of the various exemplary embodiments described herein may be combined with each other, unless specifically noted otherwise.

When docking watercraft of various hull types, including pontoon boats, it is beneficial for the watercraft to be removed from the water. Removing a watercraft from the water minimizes growth of barnacles and aquatic plant life on the watercraft, reduces the chances for the boat to acquire and transport invasive species, reduces damage from contact with a dock (e.g., "dock rash" caused by repeated rubbing of the watercraft against a dock and denting, particularly the pontoons of pontoon boats), reduces the occurrence of oxidation and discoloration of portions of the watercraft that would otherwise be submerged, and reduces the chance for damages that might result from adverse weather and water conditions (e.g., high winds, high waves, high currents, etc.).

While traditional winch-style lifts are effective at removing watercraft from the water, including lifts configured for pontoon boats, winch-style lifts have several shortcomings. First, such lifts are not suitable for use in many conditions such as in deep water locations where the legs of the boatlift cannot reach the bottom of the waterbody, where the waterbody bottom is too soft to support the legs of the boatlift, and in environmentally protected areas where the bottom of the waterbody bottom is prohibited from being disturbed. Second, when implemented with a canopy, traditional lifts can be moved from their foundation and even overturned in high winds, potentially resulting in extensive damage to the lift and other property. Third, the lifts need to removed/installed each year which is time consuming and costly. Fourth, such lifts are typically manufactured using aluminum, which becomes unsightly over time due to oxidation, and bunks for support watercraft hulls (including pontoons) are often made of wood and carpet, thereby representing ongoing maintenance and replacement issues. Fifth, some lifts are powered for loading and unloading of watercraft, thereby requiring battery maintenance or rendering them unusable in areas where power is inaccessible. Sixth, winch cables and associated pulleys may become twisted, overloaded, worn over time. Seventh, it can be difficult to align watercraft with the lift when docking, particularly under adverse weather and water conditions. Finally, it can be difficult and a potential safety hazard to load and unload passengers and gear (e.g., coolers, fishing gear, etc.) to/from a watercraft disposed on/within the lift.

In recent years, in addition to traditional winch-style lifts, floating watercraft ports have been developed. Floating watercraft ports provide easy drive-on docking and out-of-water storage of watercraft having various hull types, including pontoon boats. Pontoon boats are manufactured in a number of lengths and widths, and employ pontoons of various shapes and hull configurations (e.g., two- and three-pontoon configurations (commonly referred to as tri-toons)). Accordingly, it is advantageous for a floating drive-on pontoon port to be adjustable to accommodate and simplify the loading and unloading (to/from the port) of pontoon boats of various sizes and configurations.

Figure 2:
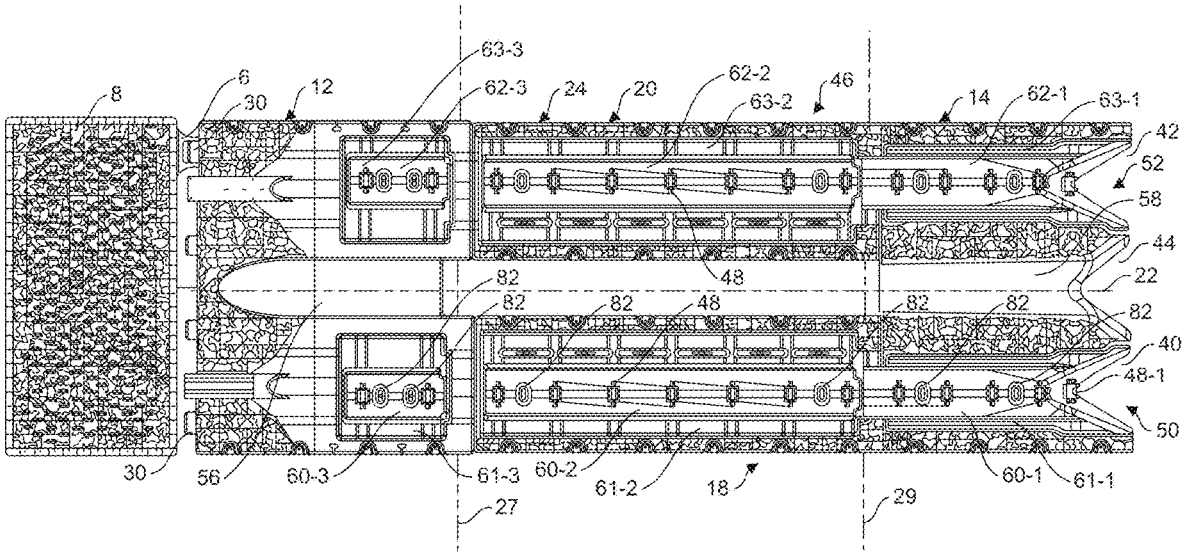
FIG. 2 is a top view of a floating drive-on pontoon port, according to one example of the present disclosure.
Figure 3:
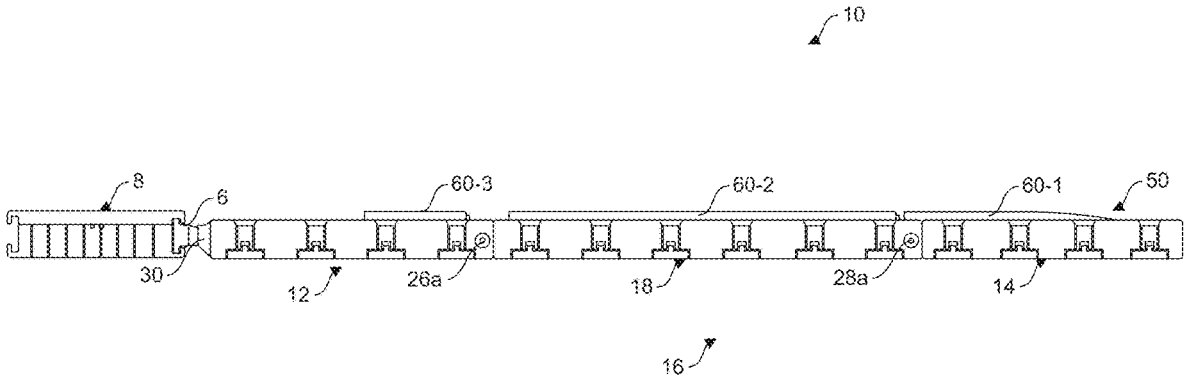
FIG. 3 is a side view illustrating a floating drive-on pontoon port, according to one example of the present disclosure.
Figure 12:
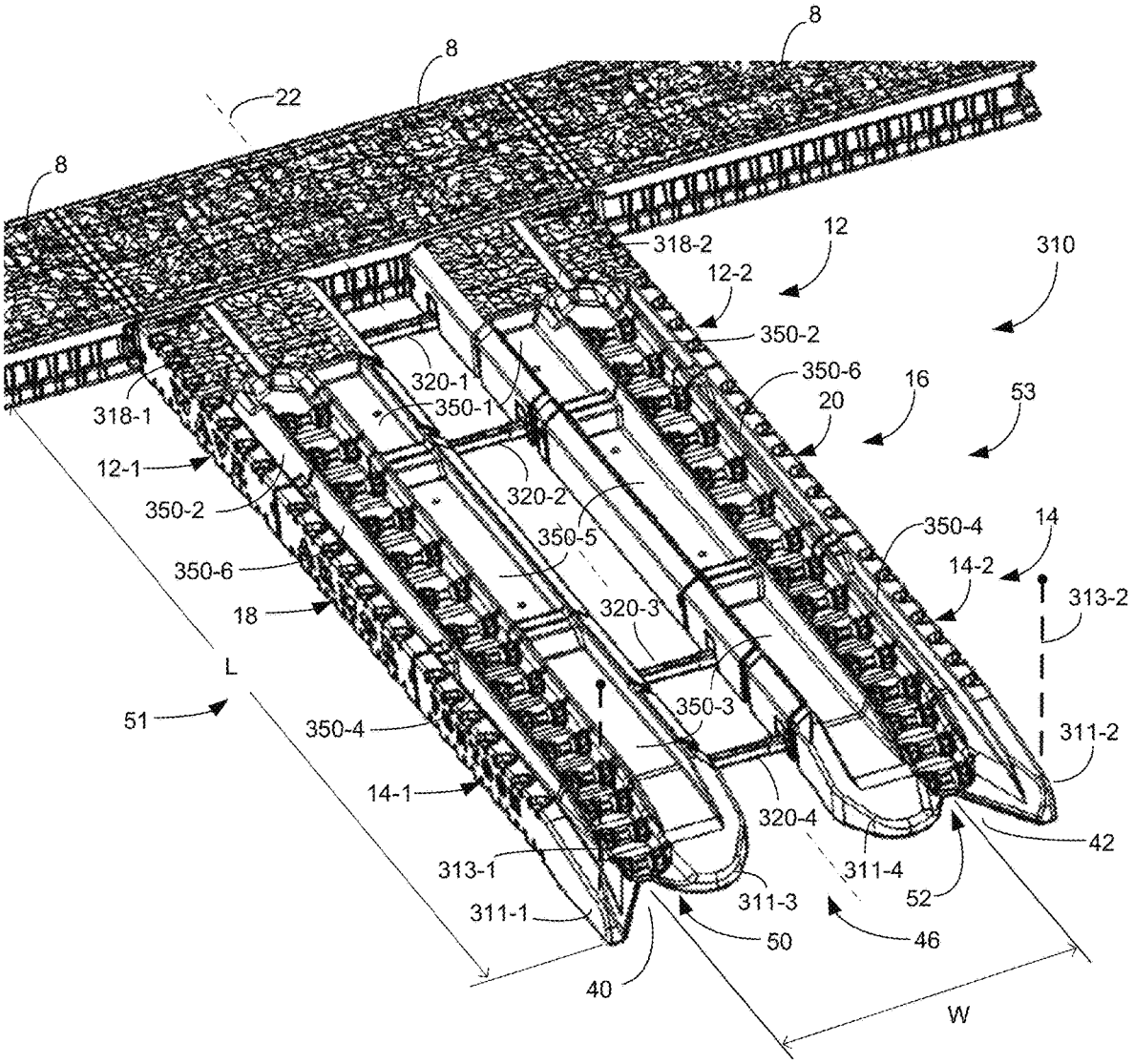
FIG. 12 is a perspective view of a floating drive-on pontoon port, according to one example of the present disclosure.

FIGS. 1-3 respectively illustrate a perspective view, a top view, and a side view of a floating drive-on pontoon port 10, according to one example. Pontoon port 10 includes a base section 12, an entrance section 14, and a midsection 16, where midsection 16 includes a port midsection 18 and a starboard midsection 20 which extend symmetrically about a longitudinal centerline 22 of pontoon port 10 between base section 12 and entrance section 14. Although illustrated in FIG. 1 as having one port midsection 18 and one starboard midsection 20, in other examples, port midsection 18 and starboard midsection 20 may each comprise multiple sections (e.g., see FIG. 8), where individual sections of port and starboard midsections 18 and 20 may be added to or removed from pontoon port 10 to adjust a longitudinal length, L, thereof to accommodate pontoon boats of different lengths. In other examples, when port and starboard sections 18 and 20 each include a single section, such single section may be available in different lengths to accommodate pontoon boats of different lengths. In yet other example, as will be describe in greater detail below, bow stops may be installed to adjust pontoon port 10 for use with pontoon boats of different lengths (e.g., see 90 in FIG. 9). In one example, base section 12 respectively includes port and starboard base sections 12-1 and 12-2, and entrance section 14 respectively includes port and starboard entrance sections 14-1 and 14-2. In one example, as illustrated by FIG. 1, port and starboard base sections 12-1 and 12-2 represent portions of a monolithic base section 12, and port and starboard entrance sections 14-1 and 14-2 represent portions of a monolithic entrance section 14. In other examples, such as illustrated by FIG. 12, port and starboard base sections 12-1 and 12-2 represent separate and independent portions of base section 12, and port and starboard entrance sections 14-1 and 14-2 represent separate and independent portions of entrance section 14.

Figure 6:
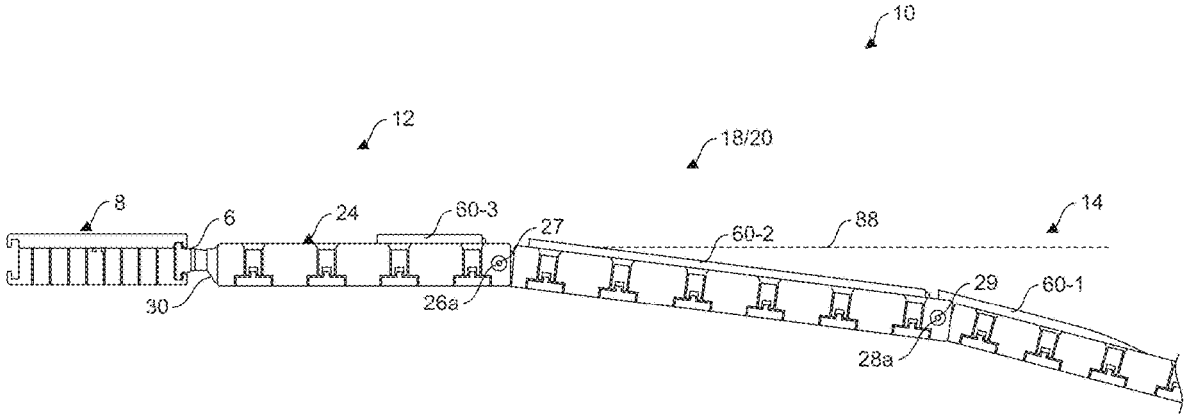
FIG. 6 is a side view illustrating a downward articulation of a floating drive-on pontoon port, according to one example of the present disclosure.
Figure 7:
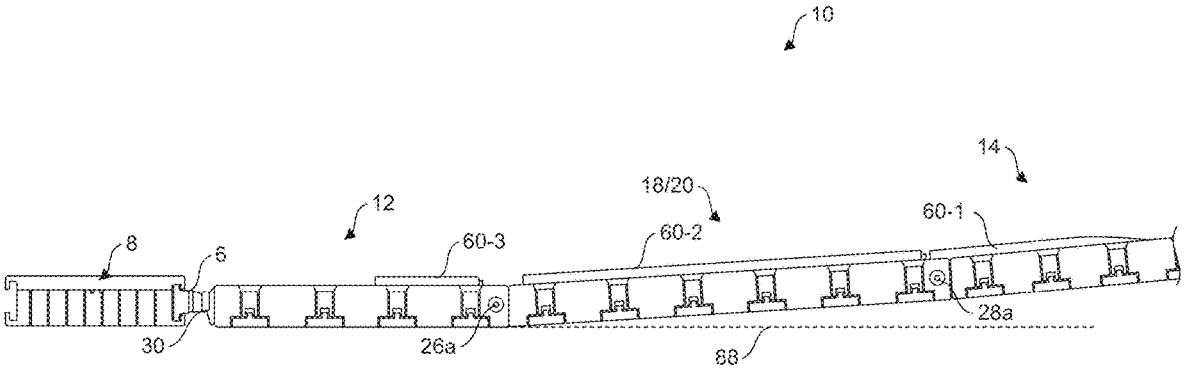
FIG. 7 is a side view illustrating an upward articulation of a floating drive-on pontoon port, according to one example of the present disclosure.

In one example, base section 12, entrance section 14 and port and starboard midsections 18 and 20 are pivotally connected to one another such that base section 12, entrance section 14, and port and starboard sections 18 and 20 can articulate and move relative to one another to better assist with on/off loading of a pontoon boat as compared to known pontoon ports lacking such articulating movement. Examples of the articulating movement of pontoon port 10 are illustrated in FIGS. 6 and 7 below. When coupled together, the upper surfaces of base section 12, entrance section 14, and port and starboard midsections 16 and 18 together form and upper surface 24 of pontoon port 10.

In one example, port and starboard sections 18 and 20 are each include a number of hinge knuckles which are received by corresponding hinge pockets in base section 12 to form respective apertures into which hinge pins 26*a* and 26*b* (see FIG. 3) are inserted to hinge port and starboard sections 18 and 20 to base section 12 so as to form a lateral axis 27 about which base section 12 and port and starboard sections 18 and 20 may pivot. Similarly, in one example, entrance section 14 includes a number of hinge knuckles which are received by corresponding hinge pockets in port and starboard midsections 16 and 18 to form respective apertures into which hinge pins 28*a* and 28*b* (see FIG. 3) are inserted to hinge entrance section 14 to port and starboard sections 18 and 20 so as to form a lateral axis 29 about which entrance section 14 and port and starboard sections 18 and 20 may pivot. With reference to FIG. 2, a number of pivoting dock connectors 30 extend from a proximate end of base section 12, where pivoting dock connectors 30 insert into corresponding channels 6 on an external structure, such as dock structure 8. As illustrated in greater detail below (e.g., see FIG. 16), dock connectors 30 adjustably connect base section 12 to dock structure 8 (e.g., enable lateral adjustment of base section 12 to dock structure 8) and allow pivotal movement of base section 12 relative to dock structure 8.

In examples, base section 12, entrance section 14, and port and starboard midsections 16 and 18 comprise rotationally molded shells of high-density polystyrene filled with a marine-grade expanded polystyrene (EPS) foam. It is noted that pontoon port 10, in accordance with the present disclosure, does not include an air tank that must be pressurized and depressurized to load/unload a pontoon boat In one example, entrance section 14 defines a port inlet 40 to receive a port pontoon of a pontoon boat, and a starboard inlet 42 to receive a starboard pontoon of a pontoon boat. In one example, entrance section 14 further includes a center inlet 44 to receive a center pontoon of a tri-toon pontoon boat, where the port, starboard, and center inlets 32, 34, and 36 are arranged symmetrically about longitudinal centerline 22 of pontoon port 10.

A transport track 46 is disposed on upper surface 24 of pontoon port 10. In one example, transport track 46 includes port transport track 50 and starboard transport track 52 extending longitudinally in parallel with one another across upper surface 24 and being disposed symmetrically about longitudinal centerline 22. In examples, port deck, entrance, and mid-sections 12-1, 14-1, and 18 together form a floating port track base 51 for port transport track 50, and starboard deck, entrance, and mid-sections 12-2, 14-2, and 20 together form a floating starboard track base 53 for starboard transport track 52. In one example, port transport track 50 comprises a series of spaced apart rollers 48 extending from port inlet 40 longitudinally across upper surface 24 of port track base 51, while starboard transport track 52 comprises a series of spaced apart rollers 48 extending from starboard inlet 42 longitudinally across upper surface 24 of starboard track base 53.

During loading and unloading of a pontoon boat on pontoon port 10, port and starboard transport tracks 50 and 52 respectively support and transport the port and starboard pontoons of the pontoon boat. In one example, deck and entrance sections 12 and 14 respectively include depressions 56 and 58 in upper surfaces 24 thereof to accommodate a third or central pontoon of tri-toon type pontoon boats.

In one example, rollers 48 of port and starboard transport tracks 50 and 52 are respectively disposed within a plurality of bunks 60 and 62 which are moveable laterally relative to longitudinal centerline 22 to enable a width, W, between longitudinal centerline of port and starboard transport tracks 50 and 52 to be adjusted to accommodate pontoon boats of different widths (i.e., the centerline distance between port and starboard pontoons of a pontoon boat). In one example, port transport track 50 includes a set of three bunks 60, including an entrance bunk 60-1 corresponding to entrance section 14, a mid-bunk 60-2 corresponding to port midsection 18, and a deck bunk 60-3 corresponding to base section 12, while starboard transport track 52 includes a set of three bunks 62, including an entrance bunk 62-1 corresponding to entrance section 14, a mid-bunk 62-2 corresponding to starboard midsection 18, and a deck bunk 62-3 corresponding to base section 12. In one example, each of the bunks 60 and 62 of port and starboard transport tracks 50 and 52 is positioned and laterally moveable within a corresponding channel within upper surface 24, with entrance bunks 60-1 and 62-1 being disposed within respective channels 61-1 and 63-1 in entrance section 14, mid-bunks 60-2 and 62-2 being disposed within respective channels 61-2 and 63-2 in port and starboard midsections 18 and 20, and deck bunks 60-3 and 62-3 being disposed within respective channels 61-3 and 63-3.

Figure 4:
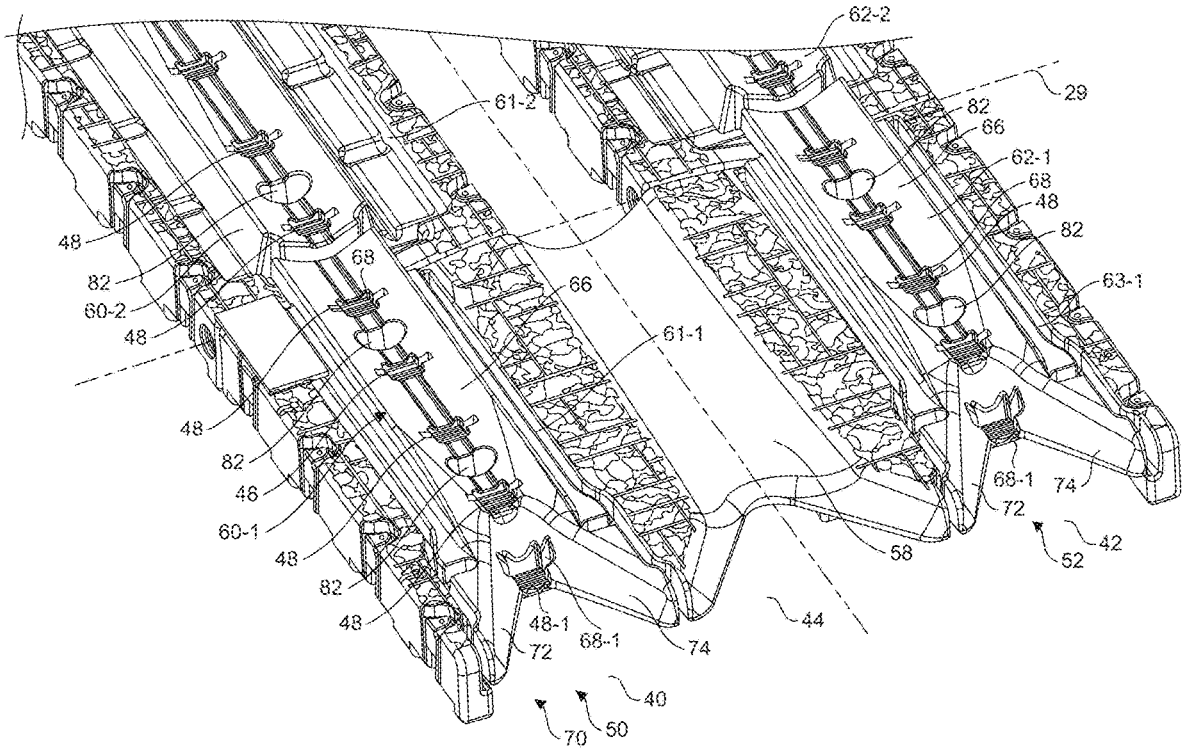
FIG. 4 is an enlarged perspective view illustrating an entrance section of a floating drive-on pontoon port, according to one example of the present disclosure.
Figure 5:
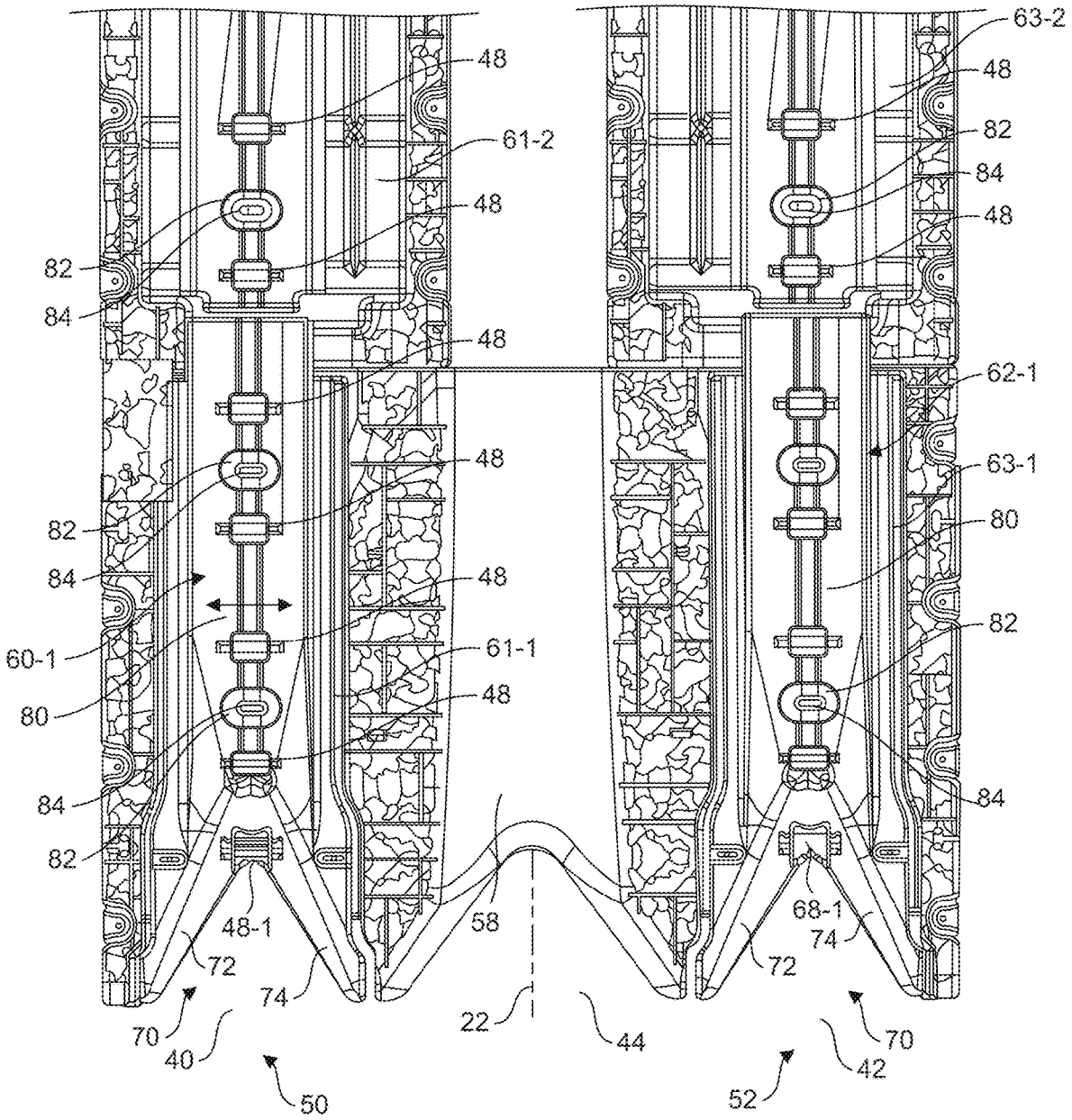
FIG. 5 is an enlarged top view illustrating an entrance section of a floating drive-on pontoon port, according to one example of the present disclosure.

FIGS. 4 and 5 respectively illustrate enlarged perspective and top views of entrance section 14 and portions of port and starboard midsections 18 and 20, including entrance bunk 60-1, according to one example. While FIGS. 4 and 5 primarily describes entrance bunk 60-1, it is noted that such description also applies to entrance bunk 62-1 and to similar elements of middle bunks 60-2 and 62-2 and deck bunks 60-3 and 62-3.

With additional reference to FIGS. 1 and 2, entrance bunk 60-1 includes a concave upper surface 66, with each roller 48 being disposed transversely across a longitudinal centerline of bunk 60-1 within a corresponding recessed roller pocket 68 in upper surface 66. When disposed within recessed roller pocket 68, a portion of roller 48 is disposed above concave upper surface 66, such that the exposed portions of rollers 48 and the concave surface 66 of bunk 60-1 form a cradle to support and guide the port pontoon of a pontoon boat during the loading, unloading, and storage of a pontoon boat on pontoon port 10.

In one example, a distal ends of entrance bunks 60-1 and 62-1 comprises a funnel-like inlet ramp 70 forming port and starboard inlets 40 and 42, where sidewalls 72 and 74 are upwardly sloped toward upper surface 24 of pontoon port 10. With reference to entrance bunk 60-1, in one example, an entrance roller 48-1 is disposed within a corresponding recessed pocket 68-1 located the base of inlet ramp 70. During loading of a pontoon onto pontoon port 10, tapered inlet 40 receives and directs a prow of the port pontoon to entrance roller 48-1. As the pontoon boat is driven forward, entrance roller 48-1 and inlet ramp 70 direct the port pontoon upwardly onto the remaining rollers 48 of port transport track 50, where rollers 48 and concave upper surfaces 66 of bunks 60-1, 60-2, and 60-3 together form a cradle for supporting the port pontoon. Starboard inlet 42, entrance bunk 62-1, and midsection bunk 62-2, and deck bunk 62-3 of starboard transport track 52 similarly guide and support the starboard pontoon of the pontoon boat.

In one example, with reference to FIG. 5, as described above, entrance bunk 60-1 is moveable laterally within corresponding channel 61-1, as indicated by directional arrow 80, to enable adjustment of the width, W, between longitudinal centerlines of port and starboard pontoon tracks 50 and 52 to accommodate pontoon boats of different widths. In one example, entrance bunk 60-1 includes a number of recessed openings 82 in concave upper surface 66 in which a fastening mechanism is disposed, and which may be selectively adjusted to secure/release entrance bunk 60-1 to/from entrance section 14. In one example, such fastening mechanism may comprises a captured bolt mechanism disposed within a slot 84 within recessed opening 82, where entrance bunk 60-1 may be laterally moved by a distance not greater than a width of slot 84. The bolt mechanism may be loosened to enable entrance bunk 60-1 to be moved laterally within channel 61-1, with the bolt mechanism disposed within slot 84, and tightened to secure entrance bunk 60-1 when at a desired position. It is noted that any suitable type of fastening or securing mechanism may be employed (e.g., a cam-lock type mechanism). Although illustrated with regard to entrance bunk 60-1, entrance bunk 62-1, midsection bunks 60-2, 62-2, and deck bunks 60-3, 62-3 are similarly adjustable.

FIGS. 6 and 7 are side views of drive-on floating pontoon port 10 respectively illustrating the downward and upward movement/articulation of base section 12, entrance section 14 and port and starboard sections 18 and 20 about lateral axes 27 and 29, according to one example. It is noted that while base section 12 is able to rotate about the hinged connection with external dock structure 8 via hinge knuckle 30 and hinge pocket 6 (see also FIG. 16), base section 12 is shown as being held in a static position to illustrate the pivoting movement of entrance section 12 and port and starboard midsections 18 and 20 about lateral axes 27 and 29. With reference to FIG. 6, the individual movement of entrance section 14, port and starboard midsections 18 and 20, and base section 12 enables each section to individually adjust when loading/unloading a pontoon boat to/from pontoon port 10. For example, when loading a pontoon boat onto pontoon port 10, each section 14, 18/20, and 12 is able to independently pivot downward as the pontoon boat is being loaded onto that section of the port and then to pivot upward as the pontoon boat moves onto the next section (e.g., from entrance section 14 to port/starboard midsections 18/20) so as to reduce impact on the pontoons and assist in providing lift as the pontoon boat moves toward base section 12. Additionally, providing independent movement of port and starboard midsections 18 and 20 relative to one another enables pontoon port 10 to better respond to and simplify loading of a pontoon boat when loads are imbalanced between the port and starboard pontoons.

Figure 8:
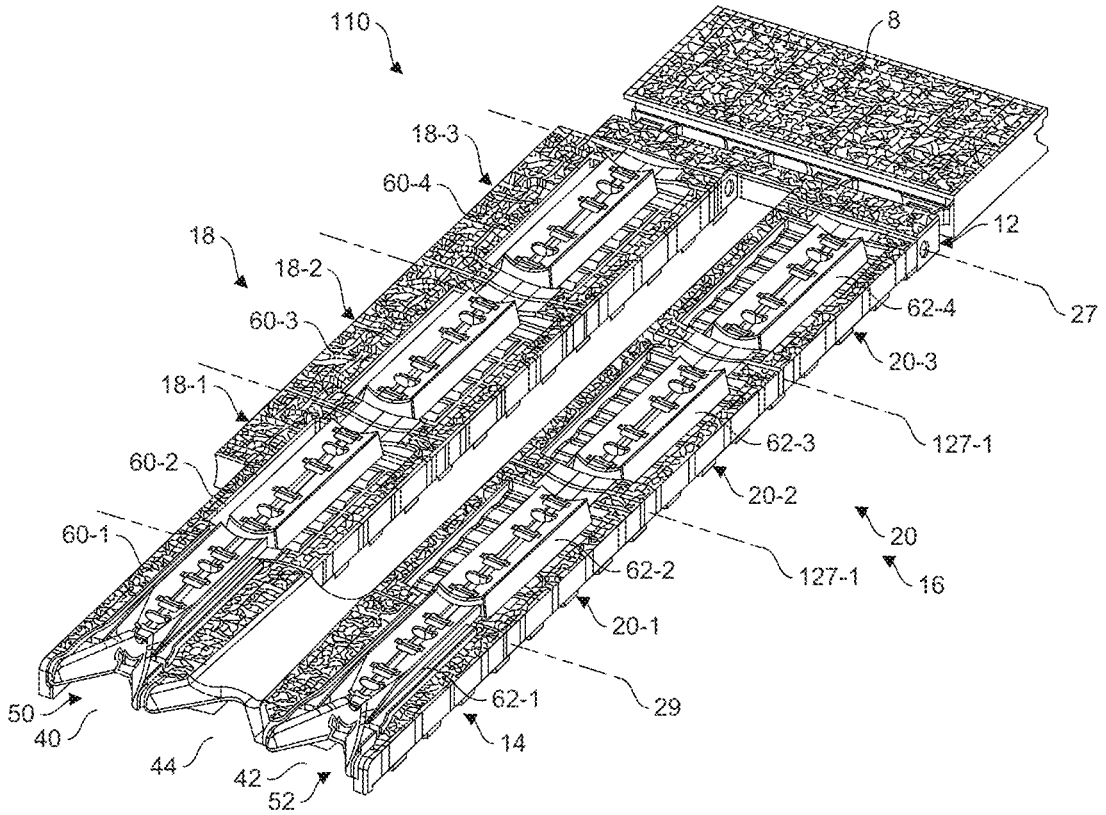
FIG. 8 is a perspective view of a floating drive-on pontoon port, according to one example of the present disclosure.

FIG. 8 is a perspective view illustrating another example of a pontoon port 110, in accordance with the present application. Pontoon port 110 is similar to pontoon port 10, except that port and starboard midsections 18 and 20 of midsection 16 each include three sections, with port midsection 18 including port midsections 18-1, 18-2, and 18-3, and starboard midsection 20 including starboard midsections 20-1, 20-2, and 20-3. Additionally, port and starboard transport tracks 50 and 52 each include four roller bunks, with port transport track 50 including entrance bunk 60-1 and mid-bunks 60-2, 60-3, and 60-4, and starboard transport track 52 including entrance bunk 62-1 and mid-bunks 62-2, 62-3, and 62-4. In the example of FIG. 8, port and starboard transport tracks 50 and 52 do not extend across portions of upper surface 24 of base section 12, with base section 12 serving as a linkage to pivotally couple port and starboard midsections 18-3 and 20-3 to external dock structure 8. As illustrated by FIG. 8, the modular arrangement of a pontoon port, in accordance with the present application, such as pontoon ports 10 and 110, enable mid-sections 18 and 20 to be added or removed from midsection 16 to adjust the length of transport tracks 50 and 52 to adapt to pontoon boats of different lengths.

Figure 9:
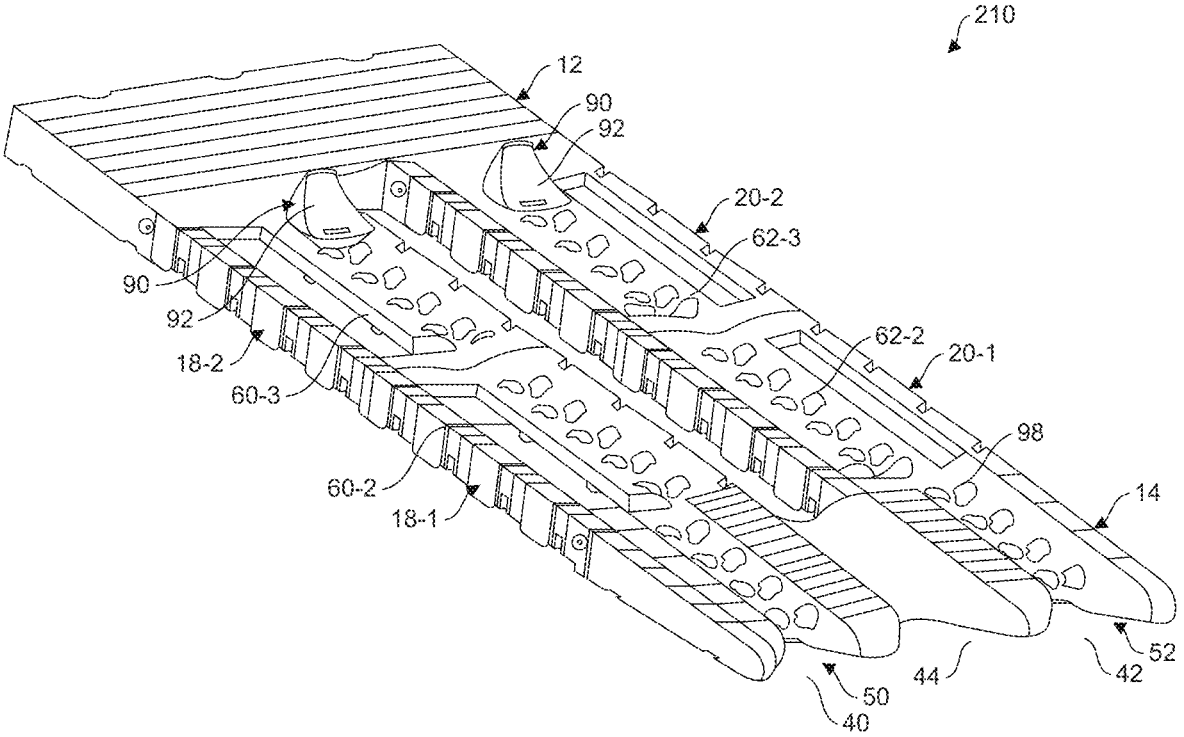
FIG. 9 is a perspective view of a floating drive-on pontoon port, according to one example of the present disclosure.

FIG. 9 is a perspective view illustrating another example of a pontoon port 210, in accordance with the present application. Pontoon port 210 is similar to pontoon port 10, except that port and starboard midsections 18 and 20 of midsection 16 each include two sections, with port midsection 18 including port midsections 18-1 and 18-2, and starboard midsection 20 including starboard midsections 20-1 and 20-2. Additionally, pontoon port 210 includes a bow stops 90 installed along port and starboard transport tracks 50 and 52 which have curved surfaces 92 which engage and serve as stops for the bows of port and starboard pontoons of a pontoon boat. In examples, bow stops 90 can be installed at any number of locations along port and starboard transport tracks 50 and 52 to adjust the lengths thereof to accommodate pontoons boats of different lengths. In one example, bow stops 90 are configured to insert within recessed openings 82 in upper surfaces 66 of roller bunks 60 and 62. In one example, bow stops 90 are secured using the same fastening mechanism employed to secure roller bunks 60 and 62 at desired positions. In one example, bow stops 90 are configured to insert within recessed roller pockets 68. It is noted that bow stops 90 may also be employed in pontoon ports 10 and 110, as illustrated by FIGS. 1-7 and FIG. 8.

Figure 10:
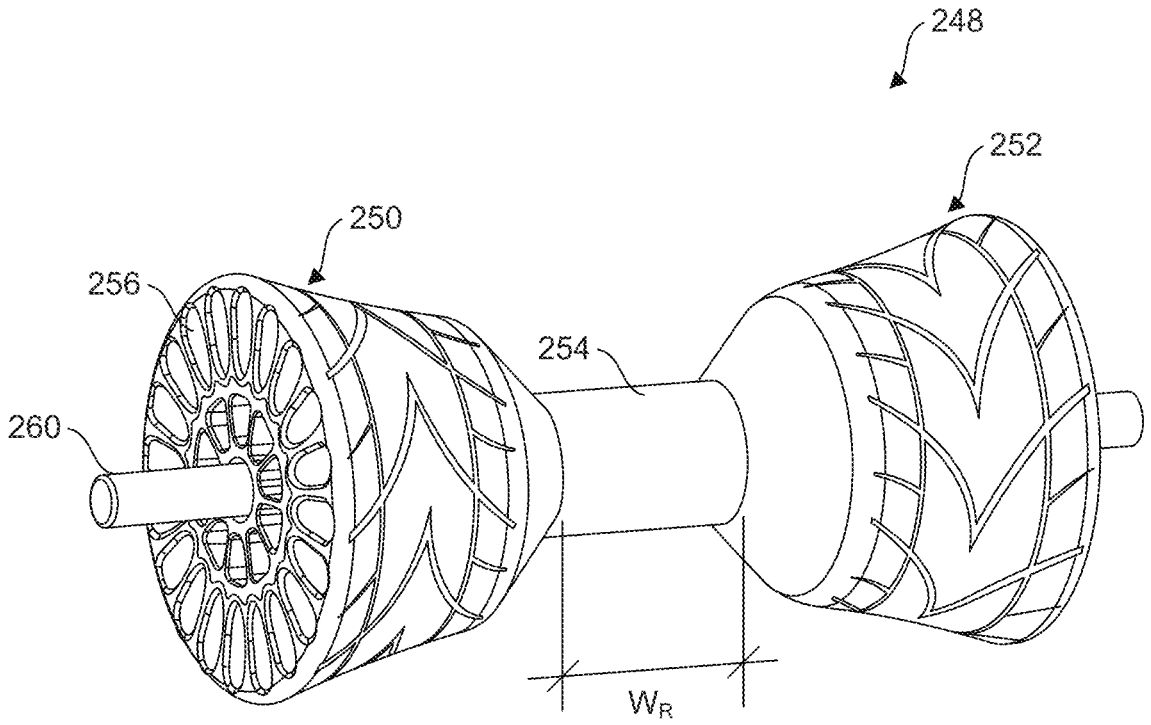
FIG. 10 is a perspective view illustrating a roller for use with a floating pontoon port, according to one example.

Furthermore, pontoon port 210 is illustrating as employing a bowtie (or dumbbell) type roller assembly 248, in lieu of a cylindrical type roller 48 illustrated as being used by pontoon ports 10 and 110 of FIGS. 1-8. FIG. 10 is a perspective view generally illustrating a bowtie roller assembly 248, according to one example. In one example, bowtie roller assembly 248 includes a pair of tapered end rollers 250 and 252, and a cylindrical center roller 254 mounted on an axel 260, where tapered end rollers 250 and 252 are spaced apart by and disposed at opposing ends of center roller 254. Tapered end rollers 250 and 252 are tapered downwardly toward center roller 254 and are configured to engage and direct a pontoon toward center roller 254 so as to be centered on a corresponding transport track, such as pontoon transport tracks 50 and 52.

Tapered end rollers 250 and 252, together with center roller 254 and concave upper surface 66 of bunks 60, 62, form a cradle to support and guide a pontoon along the corresponding transport track formed thereby, such as port and starboard transport tracks 50 and 52. In one example, tapered end rollers 250 and 252 include a number of tapered apertures 256 extending partially there through, which enable tapered end rollers 250 and 252 to flex and absorb kinetic energy from and provide a gentle transport path for port and starboard pontoons, and thereby reduce potential damage thereto. In one example, center roller 254 also includes holes extending longitudinally there through (not illustrated).

In one example, center rollers of different widths, $W_R$, may be employed with bowtie roller assembly 248 to better accommodate pontoons of various sizes. Additionally, in some examples, bushings (not illustrate) may be disposed on axel 260, where a different number of bushings being disposed on each end of axel 260 to adjust the distance, W, between port and starboard transport tracks 50 and 52 (see FIG. 1). Such adjustment of the distance, W, using such bushing may be in addition to, or in lieu of, adjustment of the distance, W, via lateral adjustment of roller bunks 60 and 62.

An example of a bowtie roller assembly 248 suitable for use with pontoon ports, in accordance with the present disclosure, such as pontoon ports 10, 110, and 210, is described by co-pending U.S. patent application Ser. No. 17/465,566, which is assigned to the same assignee as the instant application and is which incorporated herein by reference.

Figure 11:
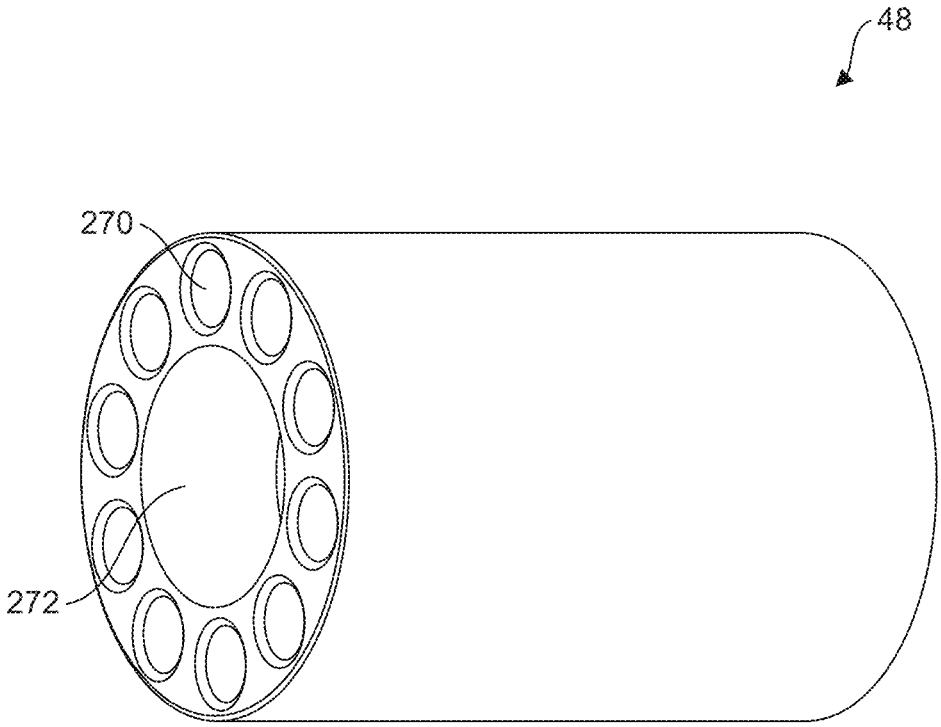
FIG. 11 is a perspective view illustrating a roller for use with a floating pontoon port, according to one example.

FIG. 11 is a perspective view generally illustrating an example of a cylindrical roller 48, as employed by pontoon ports 10 and 110 of FIGS. 1-8. In one example, cylindrical roller 48 includes a number of circumferentially spaced through-holes extending there through, and an aperture 272 to receive an axel there through. Similar to that described above, a number of bushings may be disposed on such axel to lateral adjust a position of roller 48 within its corresponding roller pocket 68 (see FIGS. 4 and 5, for example) so as to adjust the distance, W, between port and starboard transport tracks 50 and 52 (see FIG. 1).

It is noted that cylindrical rollers 48 and bowtie roller assemblies 248 may be employed in combination with one another along port and starboard transport tracks 50 and 52. For example, bowtie roller assemblies 248 may be employed as entrance rollers 48-1 in roller bunks 60-1 and 62-1 of port and starboard transport tracks 50 and 52, while cylindrical rollers 48 are employed as the remaining roller is port and starboard transport tracks 50 and 52.

FIGS. 12-19 below illustrate and describe examples of another implementation of a floating drive-on pontoon port 310, in accordance with the present disclosure. It is noted that the labels employed to identify elements of pontoon ports 10, 110, and 210 of FIGS. 1-11 above are employed to identity the same or similar elements of pontoon port 310. FIG. 12 is a top perspective view of pontoon port 310, FIG.

Figure 14:
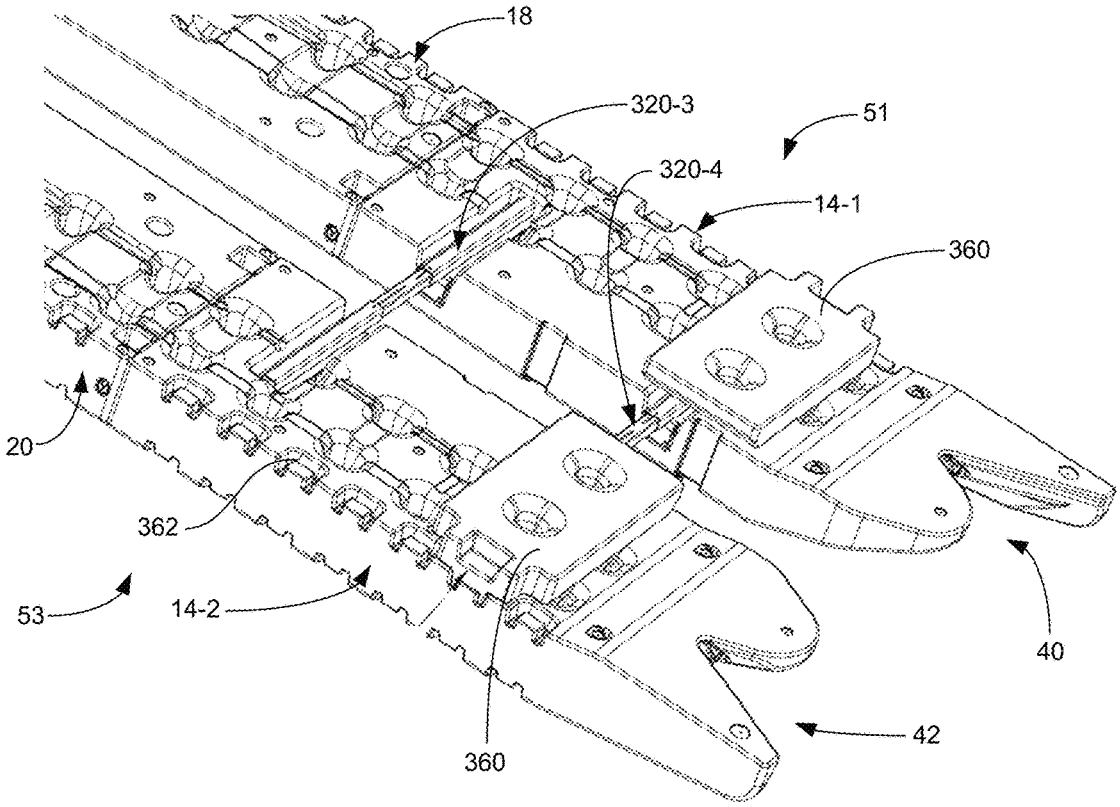
FIG. 14 is an enlarged perspective view of a portion of an underside of a floating drive-on pontoon port, according to one example of the present disclosure.

13 is an enlarged top perspective view illustrating portions of port and starboard track bases 51 and 53 of pontoon port 310, including port and starboard midsections 18 and 20, and FIG. 14 is an enlarged bottom perspective view illustrating portions of port and starboard track bases 51 and 53 of pontoon port 310, including port and starboard entrance sections 14-1 and 14-2.

According to examples, in contrast to pontoon port 10 (see at least FIGS. 2-5 above), in addition to midsection 16 having independent port and starboard midsections 16 and 18, pontoon port 310 includes base section 12 having independent port and starboard base sections 12-1 and 12-2, and entrance section 14 having independent port and starboard entrance sections 14-1 and 14-2, such that port and starboard track bases 51 and 53 are independently moveable relative to one another to enable adjustment of a width, W, between port and starboard transport tracks 50 and 52. In one example, as illustrated, port track base 51 includes port base section 12-1, port midsection 18, and port entrance section 14-1 and forms a floating laterally adjustable base for port transport track 50, while starboard track base 53 includes starboard base section 12-2, starboard midsection 20, and starboard entrance section 14-2 and forms a floating laterally adjustable base for starboard transport track 53.

In examples, port and starboard inlets 40 and 42 of pontoon port 310 respectively include outboard entrance wings 311-1 and 311-2 which extend longitudinally further along outboard sides of port and starboard entrance sections 14-1 and 14-2 relative to inboard entrance wings 311-3 and 311-4, where outboard entrance wings 311-1 and 311-2 are configured to respectively engage and direct port and starboard pontoons of a pontoon boat to port and starboard transport tracks 50 and 52 when the pontoon boat approaches pontoon port 310 at an angle (i.e., not directly in-line with port and starboard transport tracks 50 and 52). As such, entrance wings 311-1 and 311-2 provide a margin of error with regard to a position of a pontoon boat relative port and starboard transport tracks 50 and 52 when approaching and driving onto pontoon port 310. In examples, entrance wings 311-1 and 311-2 include mounting pockets to enable mounting of vertically extending entrance side guides, such as illustrated by dashed lines 313-1 and 313-2 (see FIG. 12), which mark the corners of entrance wings 311-1 and 311-2 to enable a driver of a pontoon boat to locate the outboard corners of pontoon port 310 when approaching for docking.

Additionally, in contrast to pontoon port 10, rather than disposing rollers 48 in a plurality of laterally adjustable bunks 60 (e.g., see FIG. 1), port and starboard transport tracks 50 and 52 are formed by a series of spaced apart bowtie roller assemblies 248 which, as will be described in greater detail below (e.g., see FIG. 13), are respectively mounted within port and starboard track channels 312-1 and 312-2 formed by opposing sidewalls 314 and 316 extending longitudinally across upper surface 24 of port and starboard track bases 51 and 53, where port and starboard track channels 312-1 and 312-2 are at fixed positions relative to corresponding port and starboard track bases 51 and 53.

In one example, although not explicitly illustrated, port and starboard base sections respectively include a pair of mounting channels 318-1 and 318-2 in which accessories may be secured. In one example, such an accessory comprises a bow stop (e.g., see bow stop 90 of FIG. 9), where longitudinal positions of such bow stops may be adjusted to desired locations within mounting channels 318-1 and 318-2 depending on a length of a given pontoon boat. When driving/loading a pontoon boat onto pontoon port 310, such bow stops engage the bows of the port and starboard pontoons (i.e., the leading ends of the pontoons) to provide feedback to the driver and stop the pontoon boat at a desired position on pontoon port 310. In some examples, such bow stops may be spring loaded so as to provide increasing resistance after engaging the pontoons of the pontoon boat.

In one example, to enable adjustment of the width, W, between port and starboard transport tracks 50 and 52, port and starboard track bases 51 and 53 are coupled to one another via a plurality of adjustable connector assemblies 320 which, as will be described in greater detail below (e.g., see FIGS. 14 and 15), enable positions of port and starboard track bases 51 and 53 to be laterally adjusted relative to one another to adjust width, W. In one example, as illustrated, pontoon port 310 includes connector assemblies 320-1 and 320-2 coupling port and starboard base sections 12-1 and 12-2, and connector assemblies 320-3 and 320-4 coupling port and starboard entrance sections 14-1 and 14-2.

Figure 15:
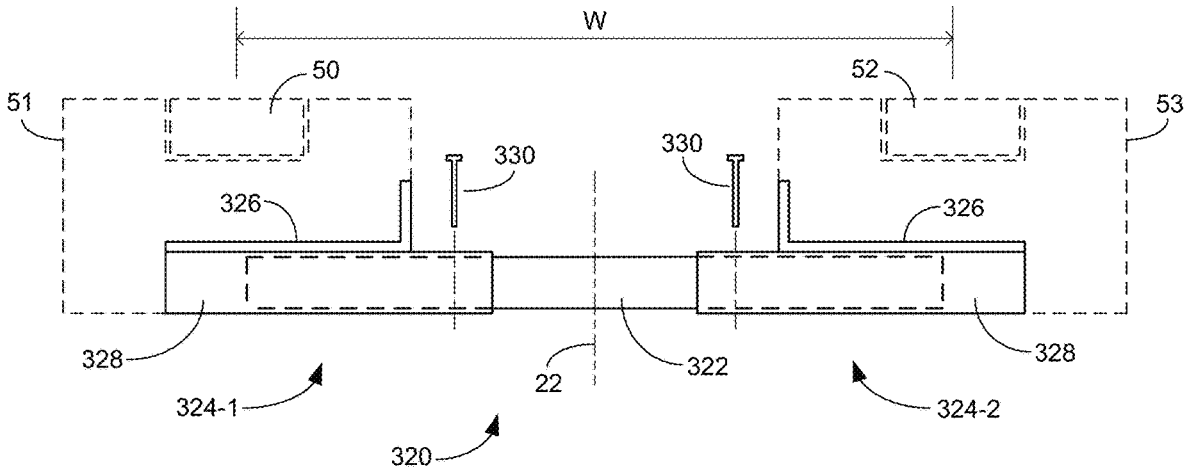
FIG. 15 is a block and schematic diagram of a connector assembly of a floating drive-on pontoon port, according to one example of the present disclosure.

FIG. 15 is a block and schematic diagram generally illustrating an adjustable connector assembly 320, according to one example of the present disclosure. Connector assembly 320 includes a slide bar 322 and a pair of opposing receiver assemblies 324, illustrated as receiver assemblies 324-1 and 324-2, with one receiver assembly 324 being connected to port track base 51 and the other attached to starboard track base 53. Each receiver assembly 324 includes a bracket 326 connected to the corresponding track base 51, 53, and a receiver bar 328 mounted to bracket 326. In examples, receiver assemblies 324 are arranged to fit within corresponding molded channels 325 within the bottom of port and starboard track bases 51 and 53 (for example, see FIG. 14). In examples, receiver assemblies 324 are connected to corresponding portions of port and starboard track bases 51 and 52 using fasteners, such as bolts, for example.

Slide bar 322 slides back and forth within receiver bars 328 of opposing receiving assemblies 324-1 and 324-2 (as indicated by the double arrows) so that the width, W, between the centerlines of port and starboard transport tracks 50 and 52 may be adjusted to a desired width, where the width, W, is centered on centerline 22 of pontoon port 310. In one example, once adjusted to a desired width, W, pins 330 are inserted through receiver bars 328 and slide bar 322 to hold slide bar 322 in place and maintain the desired width, W. In one example, slide bar 322 and receiver bars 328 are rectangular in shape to prevent rotation of slide bar 322 within receiver bars 328. Additionally, although illustrated as being secured in place with pins 330, any suitable fastening device/mechanism may be employed to secure slide bar 322 to receiver bars 328. In examples, slide bar 322 and receiver bars 238 may include a plurality of pre-drilled openings 332 through which pins 330 may be inserted, where different sets of pre-drilled openings corresponding to different standard widths, W, between port and starboard pontoons of pontoon boots. In other examples, a user may drill holes through slide bar 322 and receiver bars 328 if the pre-drilled openings do not correspond to a particular desired width, W.

Figure 16:
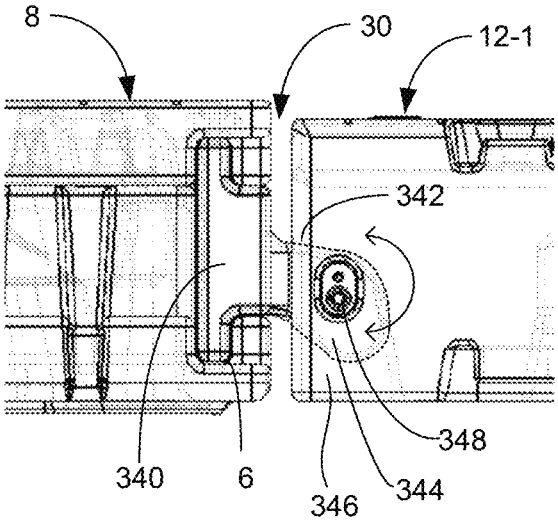
FIG. 16 is a side/cross-sectional view of a dock connector of a floating drive-on pontoon port, according to one example of the present disclosure.

FIG. 16 is an enlarged view illustrating portions of pontoon port 310 and, in particular, generally illustrating an example of dock connector 30 between base section 12, such as port base section 12-1, and a dock structure 8 (which is separate from floating pontoon port 310). In one example, port and starboard base sections 12-1 and 12-1 each include at least one dock connector 30 to adjustably connect to dock structure 8. In one example, as illustrated, dock connector 30 includes a flared slider (or base) 340 which is configured to fit within a corresponding receiving channel 6 on dock structure 8, where slider 340 is configured to slide laterally within receiving channel 6 while being retained therein. An arm 342 extends from slider 340 and defines a hinge knuckle 344 which is disposed within a hinge pocket of base section 12-1. Hinge knuckle 344 is pivotally connected to the corresponding port section 12 via a pivot shaft 348 and is able to pivot there about (as indicated by the double arrow). Dock connectors 30 enable lateral movement of port and starboard track bases 51 and 53 to enable placement at desired locations on dock structure 8 and to enable adjustment of the width, W, between port and starboard transport tracks 50 and 52. In examples, once adjusted to a desired width, W, slider elements 340 may be secured in place within channel 6.

Figure 13:
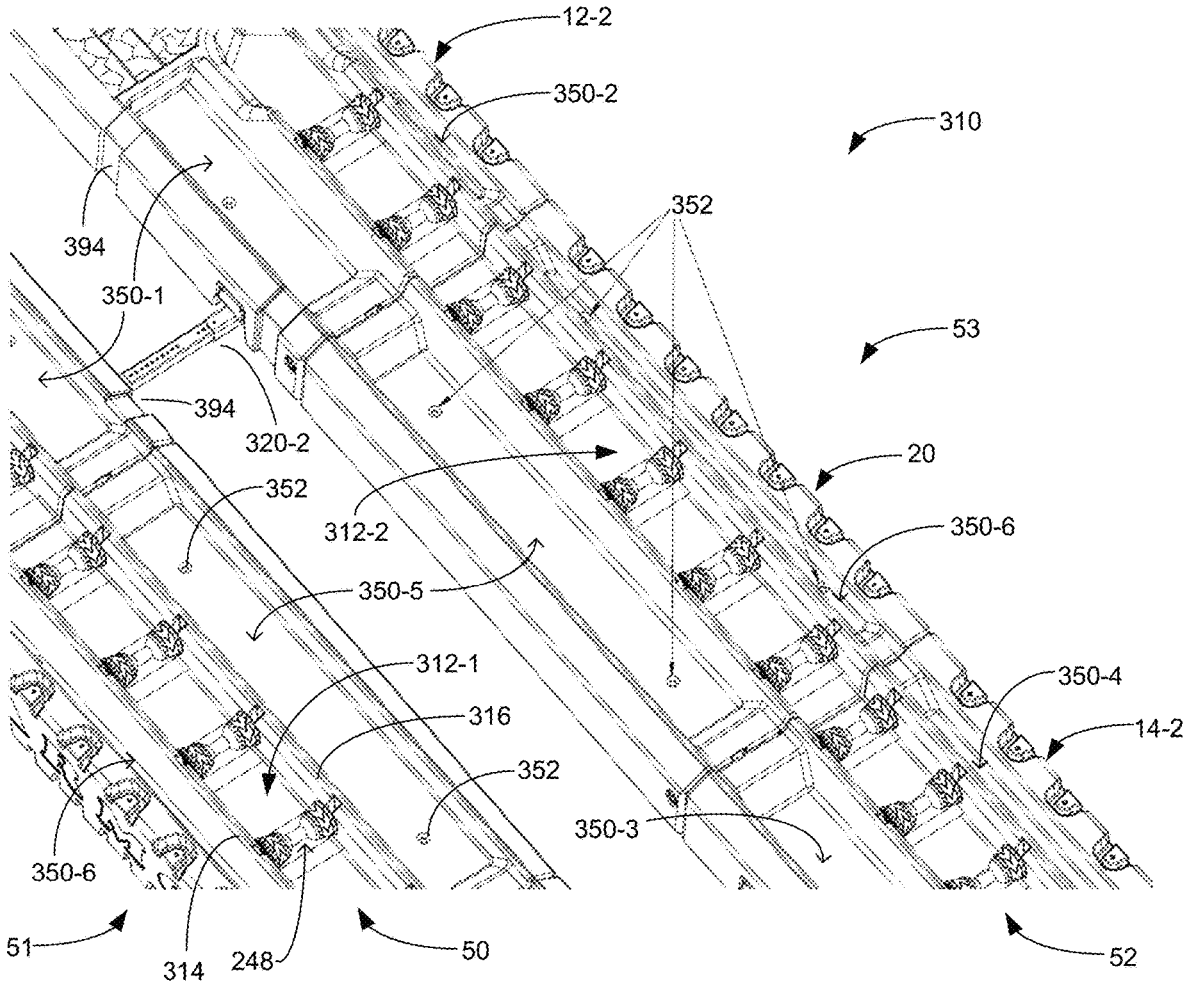
FIG. 13 is an enlarged perspective view of a portion of a floating drive-on pontoon port, according to one example of the present disclosure.

With reference to at least FIGS. 12 and 13, in one example, port and starboard base sections 12-1 and 12-2, port and starboard entrance sections 14-1 and 14-2, and port and starboard midsections 18 and 20 each include one or more self-bailing ballast tubs 350. In one example, port and starboard base sections 12-1 and 12-2 each include inboard and outboard ballast tubs 350-1 and 350-2, port and starboard entrance sections each include inboard and outboard ballast tubs 350-3 and 350-4, and port and starboard midsections 18 and 20 each include inboard and output ballast tubs 350-5 and 350-6. In examples, inboard and output ballast tubs 350-1 and 350-2 of port and starboard base sections 12-1 and 12-2, and inboard and outboard ballast tubs 350-5 and 350-6 of port and starboard midsections 18 and 20 include a plurality of drainage holes 352 to enable captured water to drain there from. In one example, in lieu of drainage holes, inboard and outboard ballast tubs 350-3 and 350-4 of port and starboard entrance sections 14-1 and 14-2 include open ends 354 facing port and starboard inlets 40 and 42 to enable the outflow of water there from.

In operation, when unloading a pontoon boat from drive-on (and drive off) floating pontoon port 310, as the motor is driven in reverse, the propeller pushes and forms a backflow of water in the direction of base section 12. As the backflow is pushed toward base section 12, water is forced into self-bailing ballast tubs 350, such that the weight of water within ballast tubs 350 assists the weight of the pontoon boat in causing the articulation and pushing of port and starboard entrance sections 14-1 and 14-2, port and starboard midsections 18 and 20, and port and starboard base sections 12-1 and 12-2 down and at least partially into the water (similar to that illustrated by FIG. 6) so that the pontoons of the pontoon boat begin to float and thereby enable the pontoon boat to be more easily driven off pontoon port 310 and into the water. Upon the pontoon boot exiting pontoon port 310, base section 12, entrance section 14, and midsections 18 and 20 float back toward the surface of the water, and captured water within ballast tubs 350 drain therefrom, and pontoon port 310 returns to an unloaded condition, such as illustrated by FIG. 3, for example. As such, ballast tubs 350 provide passive assistance (i.e., no moving parts) in unloading a pontoon boat from pontoon port 10. It is noted that ballast tubs 350 may also provide some assistance when driving a pontoon boat onto pontoon port 10, but less assistance is generally needed when driving the motor in the forward direction and driving the pontoon boat onto pontoon port 10.

Figure 18:
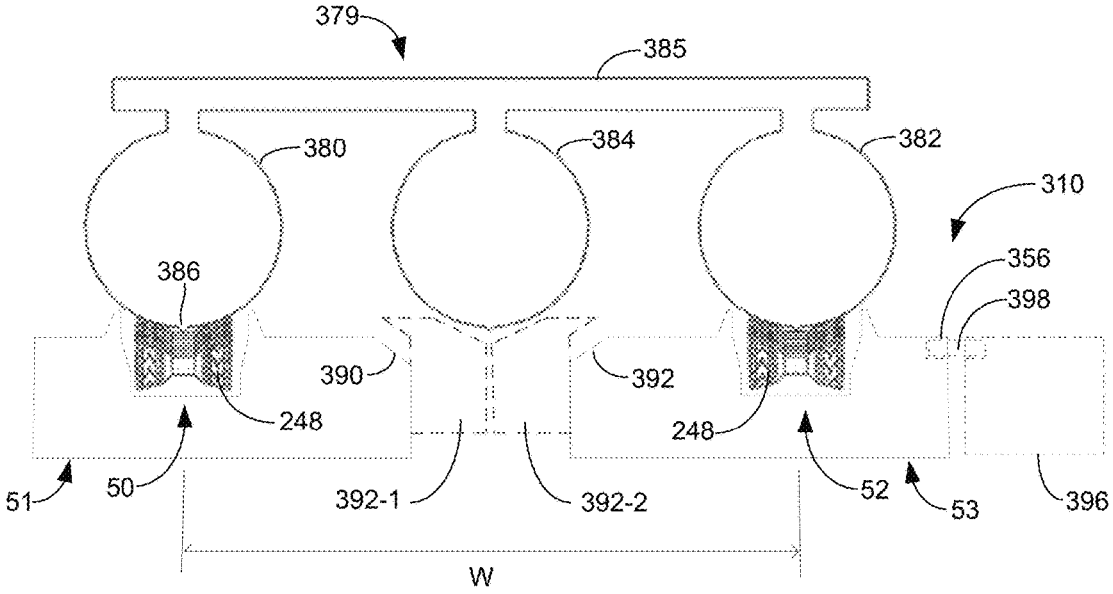
FIG. 18 is a block and schematic diagram representing an end view of a floating drive-on pontoon port, according to one example of the present disclosure, illustrating a pontoon boat stored thereon.

With reference to FIGS. 12 and 13, in examples, a series of molded mounting recesses/pockets 356 are disposed along outboard edges of port and starboard track bases 51 and 53 to enable the mounting of any number of different accessories there to. Examples of such accessories may include cleats or tie-downs to enable the securing of a pontoon boat to pontoon port 310, stanchions to enable the mounting of a canopy system to pontoon port 310 (where such canopy is coupled to and moves with pontoon port 310), connectors to enable pontoon port 310 to be coupled to adjacent structures (e.g., adjacent pontoon ports and dock structures), and, as illustrated by FIG. 18, to enable the addition of lateral deck sections to pontoon port 310 which provide additional and easy access to a pontoon boat when stored on pontoon port 310. In some examples, a connection mechanism employed to attach outboard edges of port and starboard track bases 51 and 53 to adjacent structures is configured to enable articulation of port and starboard track bases 51 and 53 when such adjacent structures are fixed elements. It is noted that such accessories are provided only as examples, and that any number of accessories may be adapted to mount to pontoon port 310 (e.g., lights, flag poles, railings and hand rails, ladders, etc.).

Figure 17:
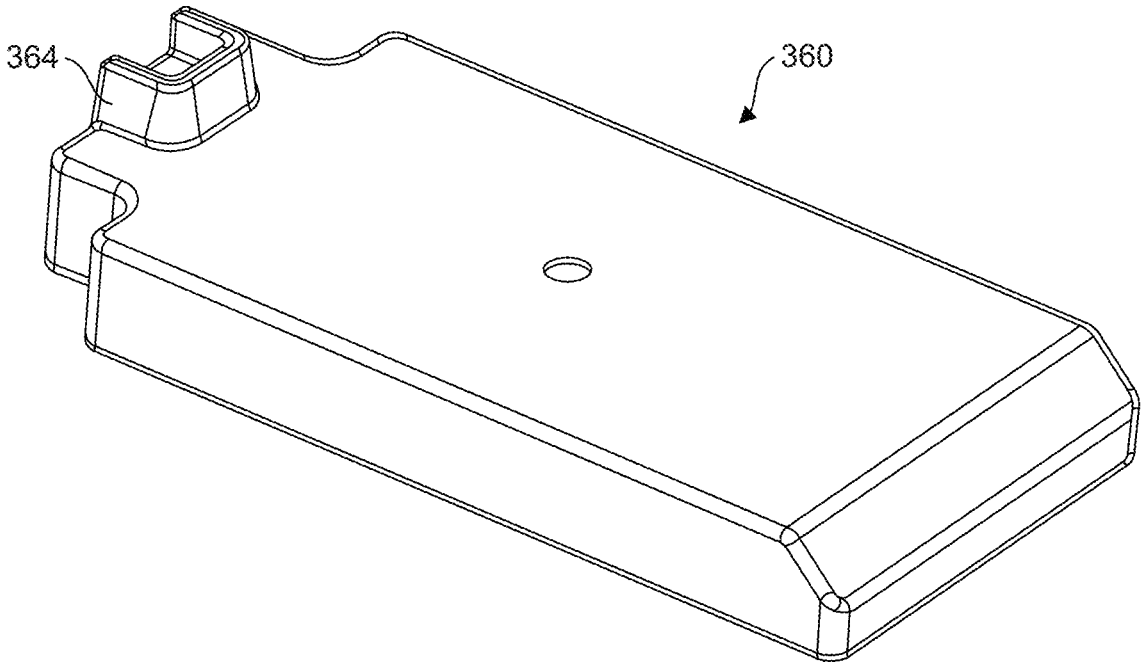
FIG. 17 is a perspective view of a ballast tank of a floating drive-on pontoon port, according to one example of the present disclosure.

With reference to FIG. 14, in examples, removeable ballast tanks 360 may be selectively attached along the lengths of port and starboard track bases 51 and 53. In one example, as illustrated, ballast tanks 360 may be attached to the bottom side of port and starboard entrance sections 14-1 and 14-2, port and starboard midsections 18 and 20, and port and starboard base sections 12-1 and 12-2, at a plurality of longitudinally spaced apart molded mounting recesses 362. FIG. 17 is a perspective view generally illustrating a ballast tank 360, according to one example, including a mounting flange 364 for insertion within mounting recesses 362 along the length of port and starboard track bases 51 and 53.

In examples, such ballast tanks 360 may be attached to port and starboard track bases 51 and 53 to provide custom leveling depending on a particular geometry and weight distribution of a given pontoon boat. In one implementation, installation locations for such ballast tanks 360, such as mounting recesses 362, enable mounting of ballast tanks 50 at regular intervals, such as every 12-inches along the lengths of port and starboard track bases 51 and 53, for example. Ballast tanks 360 provide passive buoyancy (i.e., no filling or releasing of compressed air) which can be selectively installed to provide custom leveling of port and starboard track bases 51 and 53.

With reference to FIG. 13, as described above, according to one example, port and starboard transport tracks 50 and 52 are each formed by a plurality of bowtie rollers 248 spaced apart along a portion of the length, L, of port and starboard track bases 51 and 53. In examples, bowtie rollers 248 of port and starboard transport tracks 50 and 52 are respectively mounted within port and starboard track channels 312-1 and 312-2 formed by opposing inboard and outboard sidewalls 314 and 316. In one example inboard and output sidewalls 314 and 316 respectively form a portion of the sidewalls of inboard and output ballast tubs 350. In examples, opposing ends of axels 260 of bowtie rollers 248 (see FIG. 10) are seated and secured within molded axel slots 370 in opposing inboard and outboard sidewalls 314 and 316. In one example, in addition to adjusting the lateral positions of port and starboard track bases 51 and 53 to adjust the width, W, between port and starboard transport tracks 50 and 52, bushings may be placed on axels 260 of bowtie rollers to adjust the positions of bowtie rollers 248 within port and starboard track channels 312-1 and 312-2 to further adjust the width, W.

FIG. 18 is a simplified schematic diagram generally illustrating an end view of pontoon port 310 (looking from entrance section 14 toward dock section 12), and illustrating bowtie rollers 248 of port and starboard transport tracks 50 and 52 engaging and transporting port and starboard pontoons 380 and 382 of a pontoon boat 379. In the illustrated example, pontoon boat 379 is tri-toon type boat including a center pontoon 384, with pontoons 380, 382, and 384 being connected to a deck 385. It is noted that different pontoon boats may employ pontoons having different diameters (e.g., 25-inch, 26-inch, 27-inch diameter pontoons). Additionally, pontoons may also include a keel 386. In examples, with further reference to FIG. 10, different widths, $W_R$, of center roller 254 and different sizes of tapered end rollers (end bells) 250 and 252 of bowtie roller 248 may be employed to accommodate different sizes of pontoon. As illustrated by FIG. 17, tapered end rollers 250 and 252 engage and automatically center port and starboard pontoons 380 and 382 along port and starboard transport tracks 50 and 52.

In one example, depending on the spacing, W, between port and starboard transport tracks 50 and 52, port and starboard transport based 51 and 53 may be positioned near enough to one another such that chamfered edges 390 and 392 are able to engage and support center pontoon 384 (when the pontoon boat is a tri-toon type boat). In other examples, center support elements, such as illustrated at 392-1 and 392-2 may be optionally installed along inboard sides of port and starboard track bases 51 and 52 to provide support for center pontoon 384.

In one example, such additional center support elements 392-1 and 392-2 may be secured to mounting channels 394 along inboard sides of port and starboard track bases 51 and 52 (see FIG. 13). In some examples, center support elements, such as center support elements 392-1 and 392-2 may include rollers, such as bowtie roller 248. In some examples, center support elements 392-1 and 392-2 may be disposed only along selected portions of the length, L, such as between port and starboard entrance sections 14-1 and 14-2 (where a majority of the weight of a pontoon boat is located). In other examples, center support elements 392-1 and 392-2 may be disposed along an entire length of pontoon port 310. In some examples, center support elements 392-1 and 392-2 may be laterally adjusted to enable alignment with center pontoon 384. It is noted that center support elements 392-1 and 392-2 may be installed/removed by a user to accommodate different boat configurations and geometries.

In examples, as mentioned above, longitudinally extending deck sections 396 may be connected to the outboard sides of port and/or starboard track bases 51 and 53, such as via connector elements 398 secured within mounting recesses/pockets 356. Such deck sections 396 provide a walkway along the sides of a pontoon boat when stored on pontoon port 310 and enable easy and safe access to the pontoon boat. In examples, dock sections 396 may extend along the full length, L, of pontoon port 310, or along only portions thereof. In examples, dock sections 396 may articulate with pontoon port 310. In other examples, dock sections 396 may be non-articulating with connector elements 398 configured to enable continued articulation of pontoon port 310.

Figure 19:
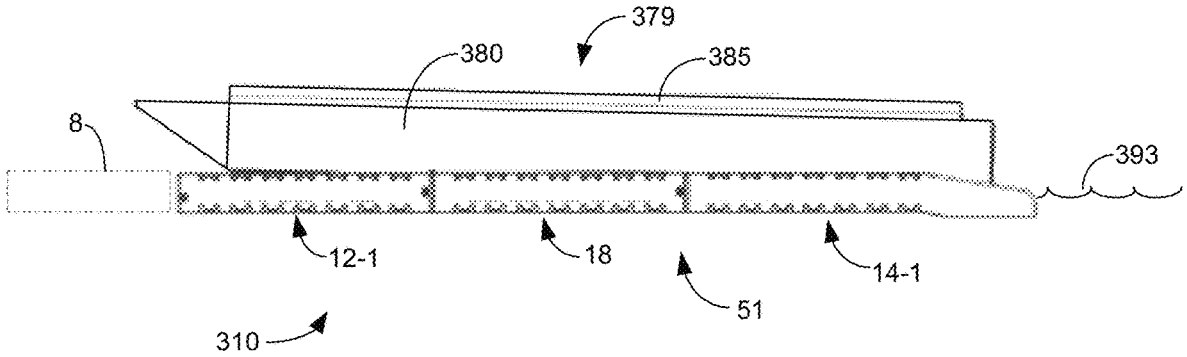
FIG. 19 is a block and schematic diagram representing a side view of a floating drive-on pontoon port, according to one example of the present disclosure, illustrating a pontoon boat stored thereon.

FIG. 19 is a schematic diagram generally illustrating a port side view of floating drive-on pontoon port 310 with pontoon boat 379 stored (loaded) thereon, such that pontoon boat 379 is lifted and stored out of the water 393.

Figure 20A:
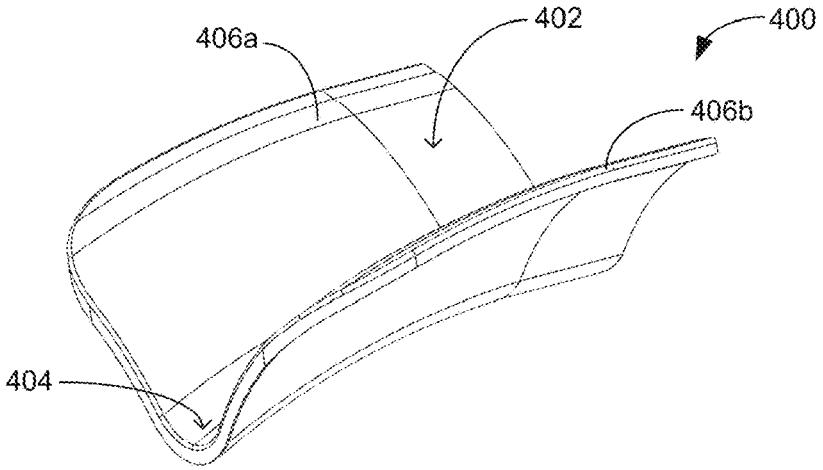
FIGS. 20A-20C generally illustrate an entrance scoop guide, according to one example of the present disclosure.
Figure 20B:
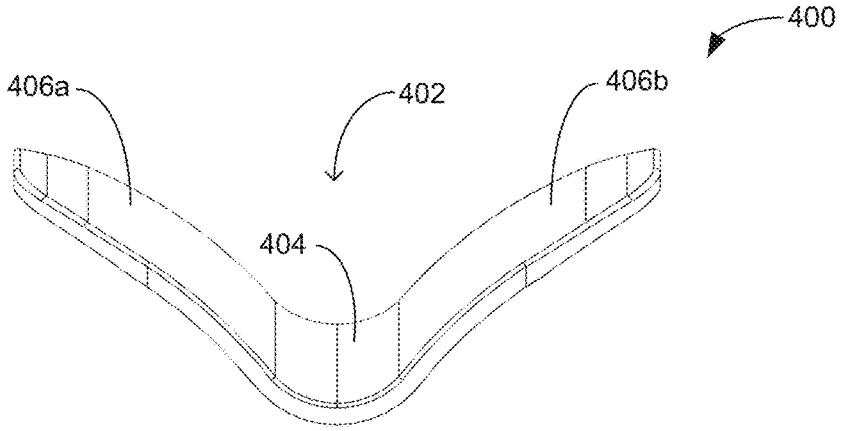
Figure 20C:
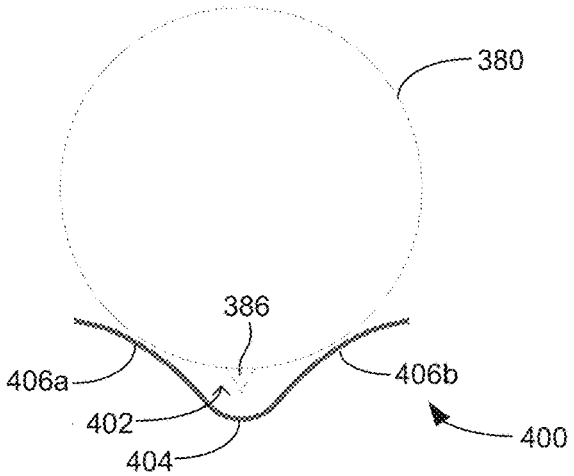

FIGS. 20A-20C below generally illustrate an entrance scoop guide 400 to be employed at the entrances to port and starboard transport tracks 50 and 52 at port and starboard inlets 40 and 42 (e.g., see FIG. 12), according to one example of the present disclosure. FIGS. 20A and 20B respectively illustrate side and front perspective views of entrance scoop guide 400. In one example, scoop guide 400 comprises a generally rounded and flared V-shaped channel 402 formed by a rounded bottom 404 and a pair of opposing outwardly flared wing-like sidewalls 406*a* and 406*b* extending upwardly from bottom 404.

With reference to FIG. 12, port and starboard transport tracks 50 and 52 each comprises a series of rollers 248 respectively beginning at port and starboard inlets 40 and 42 and extending longitudinally across the upper surfaces of port and starboard track bases 51 and 53 within port and starboard track channels 312-1 and 312-2 (see FIG. 13). In one example, in lieu of employing the first several rollers 248 (the first two rollers, or the first three rollers, for example), port and starboard transport tracks 50 and 52 each employ an entrance scoop guide 400, where the entrance scoop guide 400 forms the leading end of port and starboard transport tracks 50 and.

According to such example, during loading of a pontoon onto pontoon port 310, inboard and outboard entrance wings 311-3 and 311-1 of port inlet 40 and inboard and outboard entrance wings 311-4 and 311-2 of starboard inlet 42 respectively guide port and starboard pontoons (e.g., port and starboard pontoons 380 and 382 of FIG. 18) to entrance scoop guides 400 of port and starboard transport tracks 50 and 52. With reference to FIG. 20C, which represents a simplified cross-sectional view of entrance scoop guide 400, as a bow of a pontoon, such as pontoon 380, enters channel 402 of scoop guide 400, opposing sidewalls 406*a* and 406*b* engage and lift ("scoop up") pontoon 380 such that there is clearance between bottom 404 the keel 386 of pontoon 380. As the pontoon continues to be driven into channel 402, opposing sidewalls 406*a* and 406*b* direct and center pontoon 380 on a centerline of the corresponding transport track 50/52 and position the pontoon onto the series of rollers 248.

According to such example, initial contact/impact with the bow of a pontoon is made by entrance scoop guides 400 in lieu of a rollers 248. In one example, entrance scoop guide 400 is made from a high lubricity and abrasion resistant material. It is noted that entrance scoop guide 400 illustrated by FIGS. 20A-20*c* represents one example, and that any number of other configurations are possible which function to "scoop" the bow (leading end) of a pontoon out of the water and place/position the pontoon onto the series of rollers 248.

By employing a modular design such that a number of individual midsections may be increased or decreased, such as port and starboard midsections 18 and 20, the longitudinal length, L, of pontoon port 10/110/210/310, in accordance with the present disclosure, may be increased or decreased to accommodate pontoon boats of different lengths. Also, by employing moveable bow stops 90, which may readily be installed at various locations along port and starboard transport tracks 50 and 52, an operable length of port and starboard transport tracks 50 and 52 may be customized to match pontoon boats of any length. Further, by enabling lateral positions of port and starboard transport tracks 50 and 52 to be adjusted, such as through use of laterally adjustable roller bunks 60 and 62, through use of laterally adjustable port and starboard track bases 51 and 53, and/or through use of bushings on roller axels to adjust lateral positions of rollers 48 (and 248) the width, W, between port and starboard transport tracks 50 and 52 can be readily adjusted to accommodate pontoon boats of different widths.

Additionally, individual movement of entrance section 14, port and starboard midsections 18 and 20, and base section 12, via pivotal connections there between, enables each section to individually adjust when loading/unloading a pontoon boat to/from pontoon port 10 and thereby reduce impact on the pontoons and assist in providing improved lift as the pontoon boat moves along port and starboard transport tracks 18 and 20. Further, providing independent movement of port and starboard midsections 18 and 20 relative to one another enables pontoon port 10 to better respond to and simplify loading of a pontoon boat when loads are imbalanced between the port and starboard pontoons.

Further still, employing bowtie roller assemblies, such as bowtie roller assemblies 248, enables a shape of a cradle formed by bowtie roller assemblies 248 and concave upper surfaces 66 of roller bunks 60 and 62 to be adjusted to fit pontoons of various shapes and sizes, and provides soft surfaces for support of port and starboard pontoons along port and starboard transport tracks 60 and 62, thereby reducing for potential damage to such pontoons. Also, the arrangement and construction of a pontoon port, in accordance with the present disclosure, such as illustrated by example pontoon ports 10, 110, 210, and 310, enables drive-on and drive-off docking of a pontoon without bulky air tanks and without a corresponding pressurized air system (e.g., an air pump, air lines, etc.).

Also, employing a floating pontoon port in accordance with the present application, such as pontoon ports 10/110/210/310, enables pontoon ports to be deployed without requiring contact with the bottom of the waterbody, such as in locations where the bottom of the waterbody too soft, is environmentally protected, or the water is too deep for conventional boat lifts. Additionally, pontoon ports in accordance with the present disclosure eliminate cables, unsightly oxidation, and the potential for "boat rash" associated with conventional aluminum boat lifts. Finally, floating pontoon ports, in accordance with the present disclosure, are not subject to tipping/flipping in high winds.

Enabling adjustment of the length, L, and the width, W, between port and starboard transport tracks 50 and 52, enabling addition/removal of ballast tanks 360, and enabling addition/removal of center pontoon supports and additional side decks for access, and enabling connection to adjacent structures (e.g., adjacent docks and other adjacent floating ports) enables a user to dynamically adapt a floating pontoon port, in accordance with the present application, to fit changing needs.

Although specific embodiments have been illustrated and described herein, it will be appreciated by those of ordinary skill in the art that a variety of alternate and/or equivalent implementations may be substituted for the specific embodiments shown and described herein without departing from the scope of the present invention. This application is intended to cover any adaptations or variations of the specific embodiments discussed herein. Therefore, it is intended that this invention be limited only by the claims and the equivalents thereof.

What is claimed is:

1. A floating drive-on pontoon port, comprising: a plurality of floating sections pivotally coupled together in series with one another to form an articulating port track base and an articulating starboard track base extending longitudinally in parallel with one another, the port and starboard track bases each having a lower surface to be disposed in water and an opposing upper surface to face away from the water; a port transport track extending longitudinally across the upper surface of the port track base; and a starboard transport track extending longitudinally across the upper surface of the starboard track base and in parallel with the port transport track, the port and starboard transport tracks each comprising a series of spaced apart rollers configured to respectively receive, transport, and support a port pontoon and a starboard pontoon of a pontoon during loading, unloading, and storage of the pontoon boat on the pontoon port, wherein a lateral position of the port and starboard transport tracks relative to one another is adjustable to adjust a lateral distance between the port and starboard transport tracks to accommodate pontoon boats of different widths.

2. The floating drive-on pontoon port of claim 1, wherein the port track base and starboard track base are laterally moveable relative to one another to adjust the lateral distance between the port and starboard transport tracks to accommodate pontoon boats of different widths.

3. The floating drive-on pontoon port of claim 2, wherein lateral sides of the port and starboard track bases are connected to one another via a plurality of adjustable connector assemblies which enable lateral movement of the port and starboard track bases.

4. The floating drive-on pontoon port of claim 2, wherein the port and starboard transport tracks respectively include port and starboard track channels formed by opposing sidewalls, the port track channel at a fixed position relative to the port track base and the starboard track channel at a fixed position relative to the starboard track base, wherein opposite ends of axels of the series of rollers of the port transport track are mounted to the opposing sidewalls of the port track channel, and opposite ends of axels of the series of rollers of the starboard transport track are mounted to the opposing sidewalls of the starboard track channel.

5. The floating drive-on pontoon port of claim 2, the plurality of floating sections including:

a port base section to moveably attach to an external structure, a port entrance section defining a port inlet, and at least one port midsection extending between the base section and the entrance section, the port base section, the port entrance section, and the at least one port midsection together forming the port track base; and a starboard base section to moveably attach to the external structure, a starboard entrance section defining a starboard inlet, and at least one starboard midsection extending between the base section and the entrance section, the starboard base section, the starboard entrance section, and the at least one starboard midsection together forming the starboard track base; wherein:

the port transport track extends from the port inlet across the port entrance section, the at least one port midsection, and the port base section;

the starboard transport track extends from the starboard inlet across the starboard entrance section, the at least one starboard midsection, and the starboard base section.

6. The floating drive-on pontoon port of claim 5, wherein the at least one port midsection is pivotally coupled to the port base section and the port entrance section via respective lateral axes such that the port base section, port entrance section, and at least one port midsection, along with the port transport track disposed thereon, independently articulate about the lateral axes, and wherein the at least one starboard midsection is pivotally coupled to the starboard base section and the starboard entrance section via respective lateral axes such that the starboard base section, starboard entrance section, and at least one starboard midsection, along with the starboard transport track disposed thereon, independently articulate about the lateral axes.

7. The floating drive-on pontoon port of claim 2, including laterally adjustable support elements connectable along an inboard side of at least one port track base and starboard track base, the laterally adjustable support elements to support a center pontoon of a tri-toon type pontoon boat.

8. The floating drive-on pontoon port of claim 1, wherein the port track base and the starboard track base are at a fixed lateral position relative to one another, wherein:

the port transport track includes a number of bunks, each bunk including a different portion of the spaced apart rollers of the port transport track; and the starboard transport track includes a number of bunks, each bunk including a different portion of the spaced apart rollers of the starboard transport track, wherein a lateral position of each of the bunks of the port and starboard transport tracks is adjustable to adjust the lateral distance between the port and starboard transport tracks to accommodate pontoon boats of different widths.

9. The floating drive-on pontoon port of claim 8, wherein each bunk includes at least one fastening mechanism to selectively secure the bunk to corresponding track base at a desired lateral position.

10. The floating drive-on pontoon port of claim 8, the plurality of floating sections including:

a base section to attach to an external structure;

an entrance section defining a port inlet and a starboard inlet to respectively receive the port pontoon and starboard pontoon of the pontoon boat; and a midsection including at least one port midsection and at least one starboard midsection extending between the base section and the entrance section, wherein the port transport track extends from the port inlet across the entrance section, the at least one port midsection, and the base section, and the starboard transport track extends from the starboard inlet across the entrance section, the at least one starboard midsection, and the base section.

11. The floating drive-on pontoon port of claim 10, wherein the at least one port midsection and the at least one starboard midsection are pivotally coupled to the base and entrance sections via respective lateral axes such that the base section, entrance section, and port and starboard midsections, along with the port and starboard transport tracks disposed thereon, independently articulate about the lateral axes.

12. The floating drive-on pontoon port of claim 10, wherein portion of the upper surface of the base and entrance sections between the port and starboard transport tracks provide support to a center pontoon of tri-toon type pontoon boat.

13. The floating drive-on pontoon port of claim 1, the rollers including a plurality of bowtie rollers.

14. The floating drive-on pontoon port of claim 1, further including bow stops which can be selectively installed at a plurality of locations along the port and starboard transport tracks to adjust an operable length of the port and starboard transport tracks in the longitudinal direction.

15. A floating drive-on pontoon port for supporting a pontoon boat including:

a floating port track base to moveably connect to an external structure and supporting a port transport track;

a floating starboard track base to moveable connect to the external structure and supporting a starboard transport track, the port and starboard track bases and port and starboard transport tracks extending longitudinally in parallel with one another, the port and starboard transport tracks each comprising a series of spaced apart rollers configured to respectively receive, transport, and support a port pontoon and a starboard pontoon of the pontoon during loading, unloading, and storage of the pontoon boat on the pontoon port; and a plurality of adjustable connection assemblies connecting the port and starboard track bases, the adjustable connection assemblies to enable lateral movement of the port and starboard tracks to adjust a lateral distance between the port and starboard transport tracks to accommodate pontoon boats of different widths.

16. The floating drive-on pontoon port of claim 15, the port and starboard track bases each including a plurality of self-bailing ballast tubs, the ballast tubs to receive and fill with backflow water produced by a motor of the pontoon boat when the pontoon boat is being backed off the pontoon port, wherein a weight of the water in the ballast tubs pushes the port and track bases downward in the water enable the pontoon boat to more easily back off the pontoon port.

17. The floating drive-on pontoon port of claim 16, upon the pontoon boat exiting the pontoon port, the port and starboard track bases to floatably return to a horizontal position and the ballast tubs drain through corresponding openings.

18. The floating drive-on pontoon port of claim 15, including laterally adjustable support elements connectable along an inboard side of at least one port track base and starboard track base, the laterally adjustable support elements to support a center pontoon of a tri-toon type pontoon boat.

19. The floating drive-on pontoon port of claim 15, including a number of ballast tanks selectively coupled at preset mounting locations along undersides of the port and starboard track bases to provide additional buoyancy thereto.

20. The floating drive-on pontoon port of claim 15, wherein the port and starboard transport track bases include a plurality of mounting pockets along a length thereof to receive attachable accessories.

21. The floating drive-on pontoon port of claim 20, wherein the attachable accessories include one or more of safety railings, lights, tie-down cleats.

22. The floating drive-on pontoon port of claim 20, wherein one or more of the plurality of mounting pockets are to receive a canopy system such that the canopy system is selectively attached to and floats with the pontoon port.

23. The floating drive-on pontoon port of claim 20, including one or more floating deck sections to attach to the mounting pockets and extend longitudinally in parallel with at least portions of the port and/or starboard track bases, the floating deck sections to provide access along sides of the pontoon boat when stored on the floating pontoon port.

24. The floating drive-on pontoon port of claim 15, wherein the port and starboard transport tracks respectively include port and starboard track channels formed by opposing sidewalls, the port track channel at a fixed position relative to the port track base and the starboard track channel at a fixed position relative to the starboard track base, wherein opposite ends of axels of the series of rollers of the port transport track are mounted to the opposing sidewalls of the port track channel, and opposite ends of axels of the series of rollers of the starboard transport track are mounted to the opposing sidewalls of the starboard track channel.

25. The floating drive-on pontoon port of claim 15, the plurality of floating sections including:

a port base section to moveably attach to an external structure, a port entrance section defining a port inlet, and at least one port midsection extending between the base section and the entrance section, the port base section, the port entrance section, and the at least one port midsection together forming the port track base; and a starboard base section to moveably attach to the external structure, a starboard entrance section defining a starboard inlet, and at least one starboard midsection extending between the base section and the entrance section, the starboard base section, the starboard entrance section, and the at least one starboard midsection together forming the starboard track base; wherein:

the port transport track extends from the port inlet across the port entrance section, the at least one port midsection, and the port base section;

the starboard transport track extends from the starboard inlet across the starboard entrance section, the at least one starboard midsection, and the starboard base section.

26. The floating drive-on pontoon port of claim 25, wherein the at least one port midsection is pivotally coupled to the port base section and the port entrance section via respective lateral axes such that the port base section, port entrance section, and at least one port midsection, along with the port transport track disposed thereon, independently articulate about the lateral axes, and wherein the at least one starboard midsection is pivotally coupled to the starboard base section and the starboard entrance section via respective lateral axes such that the starboard base section, starboard entrance section, and at least one starboard midsection, along with the starboard transport track disposed thereon, independently articulate about the lateral axes.

27. The floating drive-on pontoon port of claim 25, wherein outboard corners of the port and starboard inlets each include a vertically extending entrance side guide.

28. The floating drive-on pontoon port of claim 25, wherein the port and starboard inlets each include an outboard entrance wing and an inboard entrance wing, wherein the outboard entrance wing extends longitudinally further away from away from the pontoon port than the inboard wing, and wherein the outboard entrance wings of the port and starboard inlets are configured to respectively engage and direct the port and starboard pontoons of the pontoon boat to the corresponding port and starboard transport tracks.

29. The floating drive-on pontoon port of claim 25, wherein the port and starboard inlets each include an entrance ramp upwardly sloping from a water line to the port and starboard transport tracks, respectively.

30. The floating drive-on pontoon port of claim 15, the rollers comprising bowtie rollers.

31. The floating drive-on pontoon port of claim 15, the port and starboard transport tracks each including an entrance scoop guide disposed at an entrance to the corresponding series of spaced apart rollers.

32. A floating drive-on pontoon port, comprising: a plurality of floating sections successively hinged together and forming an upper surface of the pontoon port; a port transport track and a starboard transport track extending longitudinally in parallel with one another across at least a portion of the upper surface, the port and starboard transport tracks to respectively receive, transport, and support a port pontoon and a starboard pontoon of a pontoon during loading, unloading, and storage of the pontoon boat on the pontoon port, wherein lateral positions of the port and starboard transport tracks are adjustable to adjust a lateral distance between the port and starboard transport tracks to accommodate pontoon boats of different widths.

* * * * *